US008938277B2

(12) United States Patent
Shiokawa

(10) Patent No.: US 8,938,277 B2
(45) Date of Patent: Jan. 20, 2015

(54) PLANAR MICROSTRIP FILTER DISPOSED IN A CASE AND HAVING MOVABLE STRUCTURAL COMPONENTS SPACED AT INTERVALS RELATIVE TO THE FILTER

(75) Inventor: Noritsugu Shiokawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 208 days.

(21) Appl. No.: 13/592,660

(22) Filed: Aug. 23, 2012

(65) Prior Publication Data

US 2013/0082805 A1 Apr. 4, 2013

(30) Foreign Application Priority Data

Sep. 29, 2011 (JP) ..... 2011-213691

(51) Int. Cl.
*H01P 1/203* (2006.01)
*H01B 12/02* (2006.01)

(52) U.S. Cl.
CPC ..... *H01P 1/20363* (2013.01)
USPC ..... 505/210; 333/99 S; 333/204

(58) Field of Classification Search
CPC ..... H01P 1/20327; H01P 1/20372; H01P 1/20381; H01P 1/2039
USPC ..... 333/99 S, 204, 219; 505/210
See application file for complete search history.

(56) References Cited

U.S. PATENT DOCUMENTS 3,925,740 A 12/1975 Steensma
6,049,726 A 4/2000 Gruenwald et al.
6,741,142 B1 5/2004 Okazaki et al.
2002/0050872 A1* 5/2002 Terashima et al. ..... 333/99 S
2005/0107060 A1 5/2005 Ye
2007/0164841 A1* 7/2007 Juang et al. ..... 333/205
2009/0167460 A1 7/2009 Akasegawa et al.

FOREIGN PATENT DOCUMENTS

JP 2000-269704 9/2000
JP 2001-102809 A 4/2001
JP 3929197 3/2007
JP 2007-208893 A 8/2007

OTHER PUBLICATIONS

Extended European Search Report issued Jan. 30, 2013, in European Patent Application No. 12179943.1.

(Continued)

*Primary Examiner* — Benny Lee
(74) *Attorney, Agent, or Firm* — Oblon, Spivak, McClelland, Maier & Neustadt, L.L.P.

(57) ABSTRACT

A filter of an embodiment includes: a microstrip-line planar filter that includes an input line, resonators, and an output line, and has a passband with a center frequency $f_0$; a metal case housing the planar filter; and structural components that include dielectric components, the structural components arranged in the metal case at an interval in the traveling direction of electromagnetic waves from the input line to the output line or in a direction perpendicular to the wavefront of the standing waves generated by the electromagnetic waves resonating in the metal case, the interval being ⅕ to ½ wavelength in terms of the electrical length of the center frequency $f_0$.

9 Claims, 34 Drawing Sheets

(56) References Cited

OTHER PUBLICATIONS

Office Action issued on Nov. 26, 2013 in the corresponding Japanese Patent Application No. 2011-213691 (with English Translation).

Combined Chinese Office Action and Search Report issued May 27, 2014 in Patent Application No. 201210310249.3 with English Translation.

* cited by examiner

Z
Y
X

Z
Y
X

Z
Y
X

Z
Y
X

Z
Y
X

0dB
-100dB

0dB
-100dB

8 GHz
12 GHz
0dB
-100dB

8 GHz
12 GHz

PLANAR MICROSTRIP FILTER DISPOSED IN A CASE AND HAVING MOVABLE STRUCTURAL COMPONENTS SPACED AT INTERVALS RELATIVE TO THE FILTER

CROSS-REFERENCE TO RELATED APPLICATION

This application is based upon and claims the benefit of priority from Japanese Patent Application No. 2011-213691, filed on Sep. 29, 2011, the entire contents of which are incorporated herein by reference.

FIELD

Embodiments described herein relate generally to filters.

BACKGROUND

A planar filter of a one-side open type such as a microstrip-line type has the advantage that the planar filter can be easily manufactured and adjusted. Having one side open, however, such a planar filter is likely to be affected by the outside environment, and emits electromagnetic waves to disturb the outside environment. This tendency becomes more conspicuous at higher frequencies. One simple technique for eliminating this drawback is to seal a planar filter in a metal case. Then, unnecessary propagation of electromagnetic waves inside and outside the metal case is completely shut off.

However, a metal case housing a planar filter leads to another problem. This problem is caused by cavity mode resonance of the metal case. For example, input power into a planar filter induces cavity mode resonance, and the cavity mode resonance is picked up by the output line of the planar filter. As a result, a passband is formed in a frequency band that is not included in the design of the planar filter, or the filter frequency characteristics are greatly degraded.

As one of the methods for solving the above problems, there has been a method by which unnecessary higher-order mode shield plates made of a conductor or a high-permittivity dielectric material are used.

DETAILED DESCRIPTION OF THE INVENTION

Figure 1:
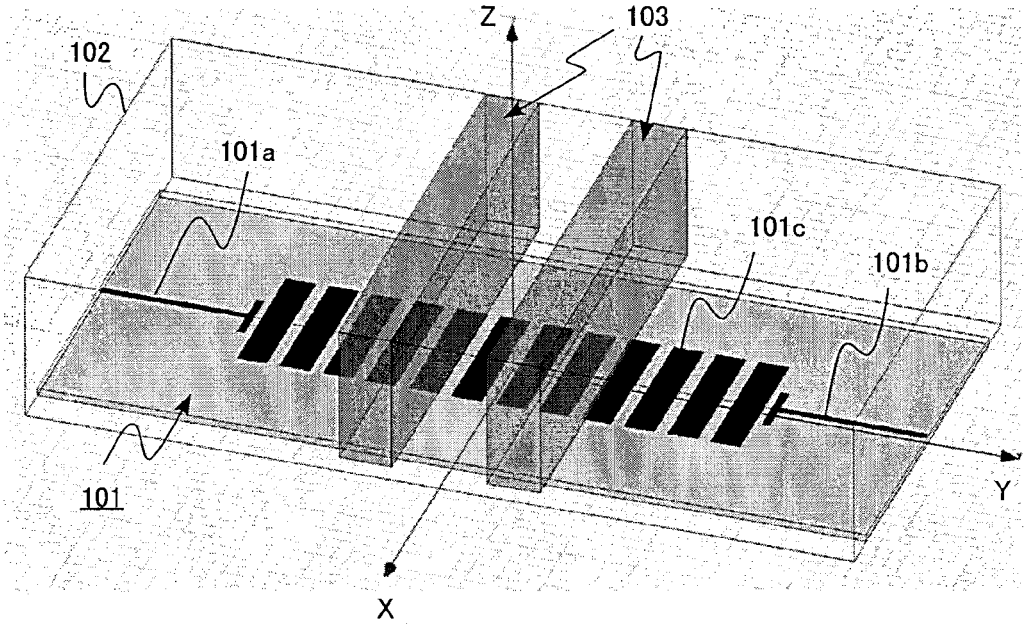
FIG. 1 is a perspective view of a filter according to a first embodiment.

A filter of an embodiment includes: a microstrip-line planar filter that includes an input line, resonators, and an output line, and has a passband with a center frequency $f_0$; a metal case housing the planar filter; and structural components that include dielectric components, the structural components arranged in the metal case at an interval in the traveling direction of electromagnetic waves from the input line to the output line or in a direction perpendicular to the wavefront of the standing waves generated by the electromagnetic waves resonating in the metal case, the interval being ⅕ to ½ wavelength in terms of the electrical length of the center frequency $f_0$.

Where propagation of electromagnetic waves in a metal case is suppressed by providing shield plates in the metal case is used, resonance of each shield plate or cavity resonance between the shield plates might adversely affect the filter characteristics. The shield plates provided in a metal case are designed to shield electromagnetic waves propagating in the metal case and increase the attenuation in the stopband of the filter. However, where resonance of each shield plate or cavity resonance between the shield plates exists near the center frequency of the filter, a passband may be formed in the stopband due to the resonance.

Also, where shield plates made of a conductor or dielectric shield plates with high dielectric loss are provided, the insertion loss of the filter is degraded or become high due to the loss in the shield plates. This is particularly conspicuous in cases where the loss in a planar filter is extremely low, such as a case where the conductor portion of a planar filter is made of a superconductor. In general, the dielectric loss is higher for a dielectric material with a higher permittivity.

Where a narrowband bandpass filter is manufactured, the resonators constituting the filter need to be tuned to have exactly the designed frequencies. Therefore, the resonance frequency often needs to be adjusted externally of the filter after the manufacture of a planar filter. The existence of shield plates makes it difficult to perform such frequency adjustment from outside.

The following is a description of embodiments, with reference to the accompanying drawings. In the drawings, like components are denoted by like reference numerals and may not be described in detail in all drawing figures in which they appear.

First Embodiment

A filter of this embodiment includes: a microstrip-line planar filter that includes an input line, resonators, and an output line, and has a passband with a center frequency $f_0$; a metal case housing the planar filter; and structural components that include dielectric components, the structural components arranged in the metal case at an interval in the traveling direction of electromagnetic waves from the input line to the output line or in a direction perpendicular to the wavefront of the standing waves generated by the electromagnetic waves resonating in the metal case, the interval being ⅕ to ½ wavelength in terms of the electrical length of the center frequency $f_0$. In this embodiment, the structural components each have a plate-like form.

In this specification, the distance between two structural components is typically the distance between the centers of gravity of the two structural components.

To readily isolate a microstrip-line planar filter from the outside environment, a metal case is provided to cover the peripheral portions of the microstrip-line planar filter. Where a microstrip-line planar filter is covered with a metal case, however, the metal case functions as a waveguide, and the input and the output of the filter are connected via the propagating mode of the waveguide.

As a result, an extra propagation path of electromagnetic waves is added, and the out-of-passband attenuation of the filter becomes smaller, compared with the characteristics of a planar filter without a cover. In other words, the background level becomes higher.

To avoid such a situation, dielectric structural components are provided in a metal case in this embodiment, and propagation of electromagnetic waves is hindered. However, each dielectric structural component also functions as a resonator, and forms a passband near the resonance frequency thereof. If the passband exists near the center frequency $f_0$ of the planar filter, the transmission characteristics of the planar filter are adversely affected, and/or the out-of-passband attenuation of the planar filter is reduced.

To avoid such problems, dielectric structural components are arranged at intervals in the traveling direction of electromagnetic waves propagating from the input line to the output line of the filter in the metal case or in a direction perpendicular to the wavefront of the standing waves generated by the electromagnetic waves resonating in the metal case. Each of the intervals is approximately ⅕ (one fifth) to ½ (a half) wavelength in terms of the electrical length of the center frequency $f_0$ of the passband of the planar filter.

FIG. 1 is a perspective view of a filter of this embodiment. The filter of this embodiment includes a planar filter 101, a metal case 102 housing the planar filter 101, and two structural components 103 including dielectric components arranged in the metal case 102.

The planar filter 101 is formed using a microstrip-line planar filter substrate which has a ground plane at the lower surface, and a filter circuit pattern at the upper surface. The microstrip-line planar filter substrate is a dielectric substrate. The planar filter 101 is a microstrip-line planar filter.

The planar filter 101 includes an input line 101*a* and an output line 101*b* in left and right portions thereof. The planar filter 101 is a 12-pole Chebyshev bandpass filter formed with twelve strip-type resonators 101*c*, the input line 101*a* and the output line 101*b*. The center frequency $f_0$ of the filter is 10 GHz, for example.

Coaxial-microstrip connectors or the like are attached to the left and right ends of the metal case 102, so that input and output extraction from the filter can be performed.

The structural components 103 are two dielectric components that are arranged at a distance from each other in the traveling direction of electromagnetic waves propagating from the input line 101*a* to the output line 101*b* of the filter in the metal case 102 or in a direction perpendicular to the wavefront of the standing waves generated by the electromagnetic waves resonating in the metal case 102. The distance between the two dielectric components is approximately ⅕ to ½ wavelength in terms of the electrical length of the center frequency $f_0$ of the passband of the planar filter 101. In this embodiment, the dielectric structural components each have a plate-like shape.

As the structural components 103 are dielectric components, power loss due to generation of eddy current or the like can be suppressed.

The effects to be achieved from the above described structural components will be sequentially described below, based on the results of three-dimensional electromagnetic field simulations.

Figure 2:
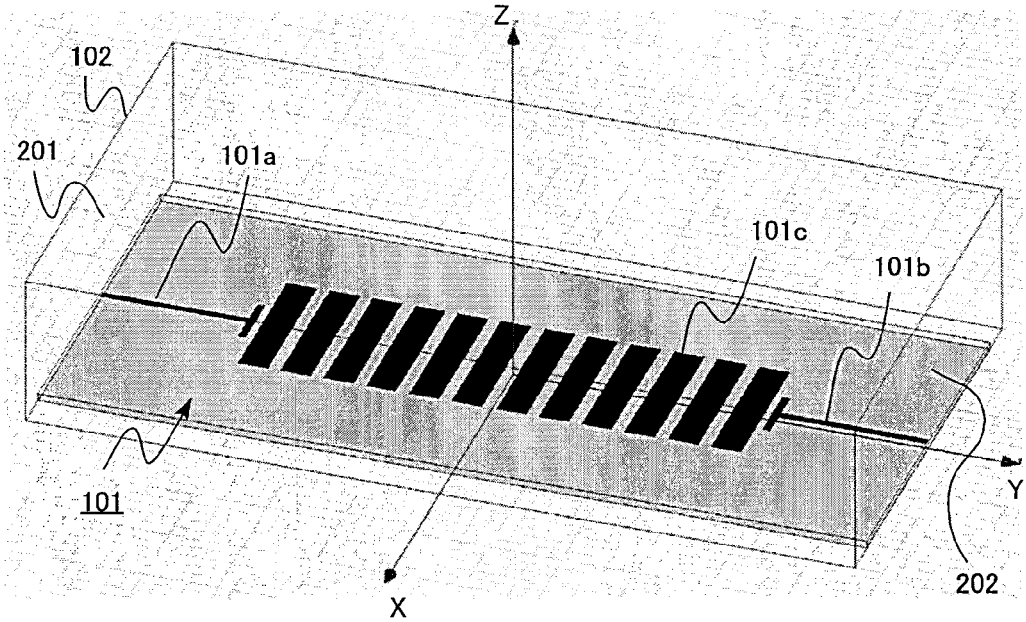
FIG. 2 is a perspective view of a structure on which a three-dimensional electromagnetic field simulation is performed.

FIG. 2 is a perspective view of a structure on which a three-dimensional electromagnetic field simulation is performed. In this structure, dielectric structural components are not provided in the metal case 102. In the simulation described below, the characteristics obtained when the metal case 102 is regarded as a waveguide are calculated.

Figure 3:
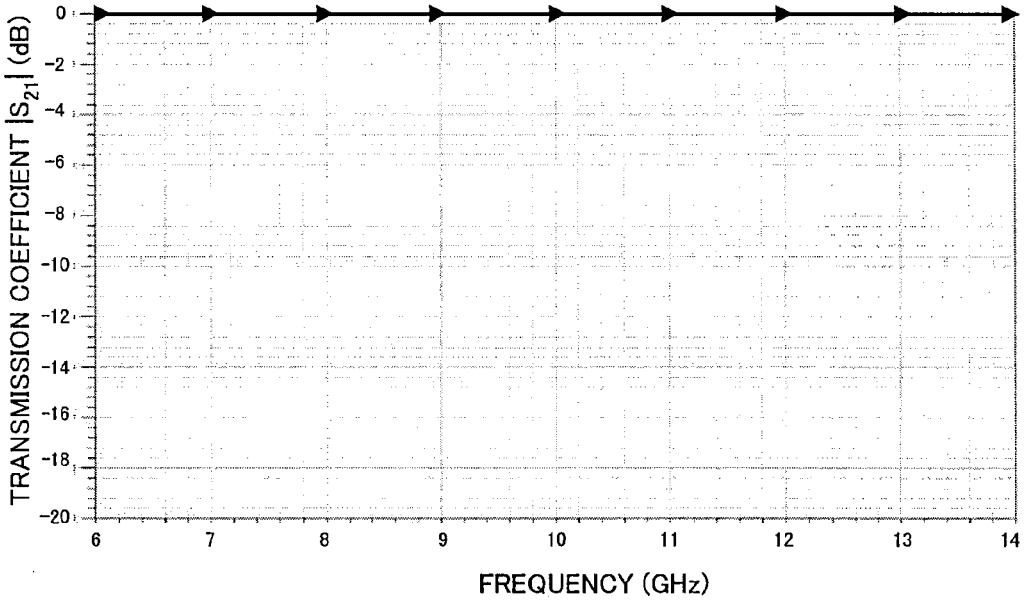
FIG. 3 is a graph showing the results of the simulation performed on the structure of FIG. 2.

FIG. 3 is a graph showing the results of the simulation performed on the structure of FIG. 2. Specifically, FIG. 3 shows the results of a transmission characteristics calculation performed where the left and right surfaces 201 and 202 of the metal case 102 in FIG. 2 were used as the input and output ports.

In the graph of FIG. 3, the horizontal axis indicates frequency (6 to 14 GHz), and the vertical axis indicates the transmission coefficient $|S_{21}|$ (−20 to 0 dB) between the ports. Where dielectric structural components do not exist in the metal case 102 as shown in FIG. 2, substantially all-pass characteristics are achieved in this frequency range.

Figure 4:
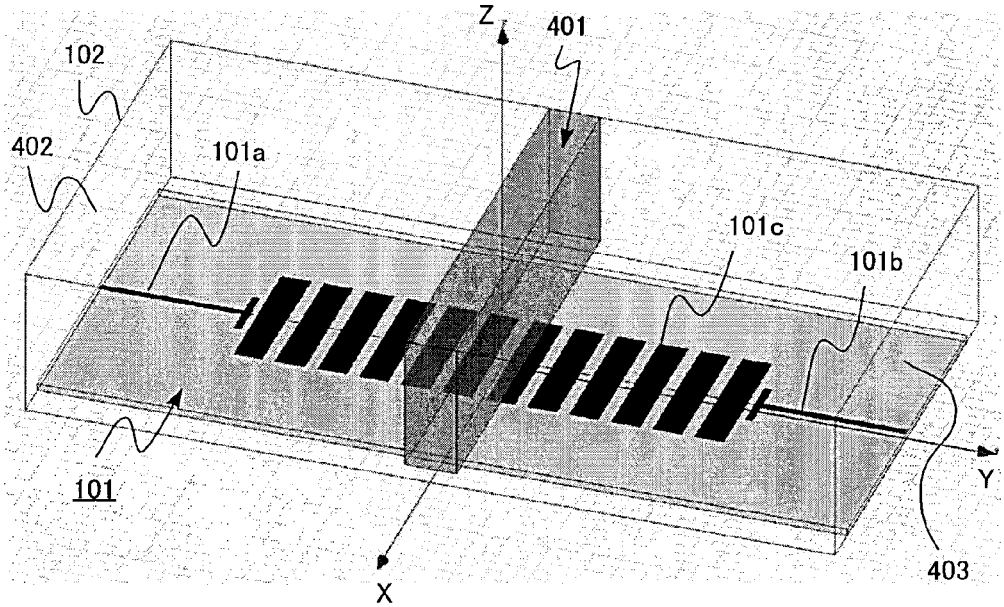
FIG. 4 is a perspective view of a structure on which a three-dimensional electromagnetic field simulation is performed.

FIG. 4 is a perspective view of a structure on which a three-dimensional electromagnetic field simulation is performed. A dielectric structural component 401 is provided in the metal case 102.

Figure 5:
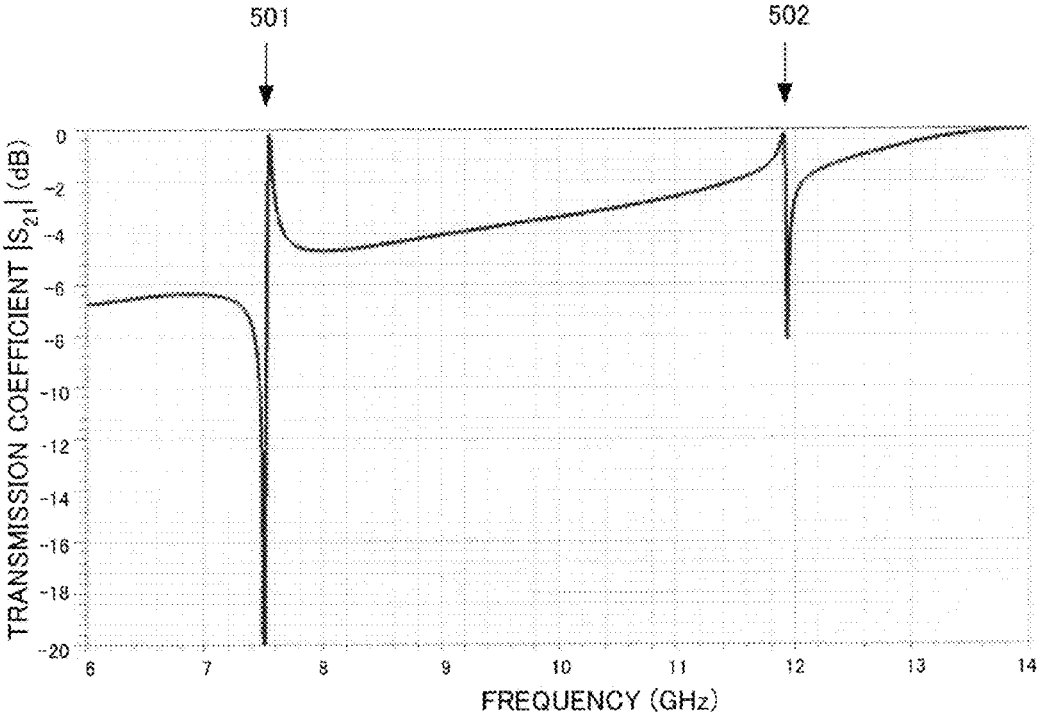
FIG. 5 is a graph showing the results of the simulation performed on the structure of FIG. 4.

FIG. 5 is a graph showing the results of the simulation performed on the structure of FIG. 4. Specifically, FIG. 5 shows the results of a transmission characteristics calculation performed where the left and right surfaces 402 and 403 of the metal case 102 in FIG. 4 were used as the input and output ports.

In the graph of FIG. 5, the horizontal axis indicates frequency (6 to 14 GHz), and the vertical axis indicates the transmission coefficient $|S_{21}|$ (−20 to 0 dB) between the ports. As can be seen from FIG. 5, the transmission coefficient becomes smaller in the entire frequency range due to reflection by the dielectric structural component 401 in FIG. 4, but transmission peaks appear at points 501 and 502 due to the resonance of the structural component. The decrease in the transmission coefficient is smaller at higher frequencies.

Figure 6:
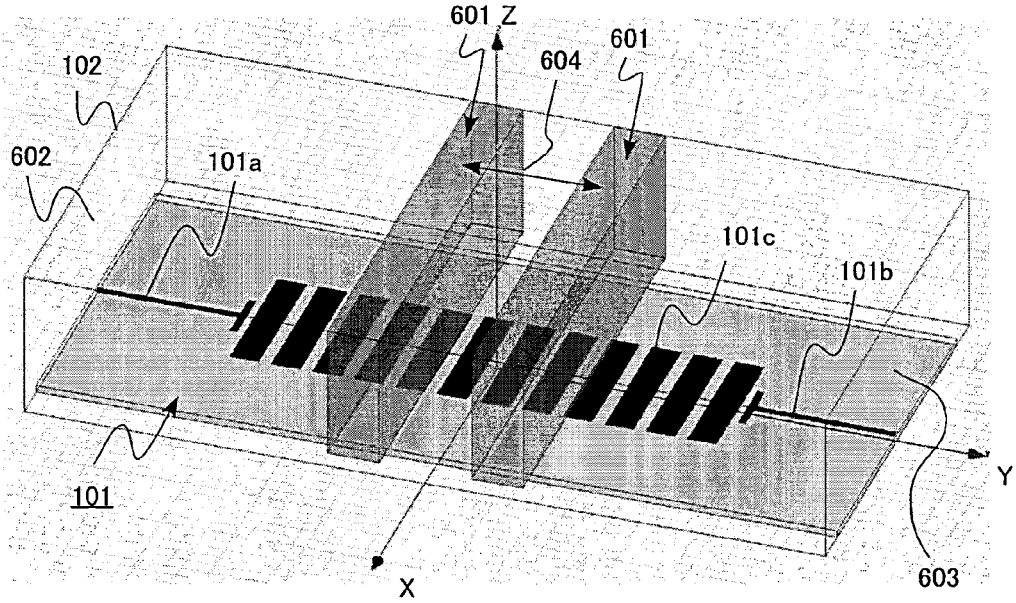
FIG. 6 is a perspective view of a structure on which a three-dimensional electromagnetic field simulation is performed.

FIG. 6 is a perspective view of a structure on which a three-dimensional electromagnetic field simulation is performed. In this structure, two dielectric structural components 601 are provided in the metal case 102. Here, the distance 604 between the two dielectric structural components 601 is λ/3 in terms of the electrical length at 10 GHz, which is the center frequency of the planar filter 101.

Figure 7:
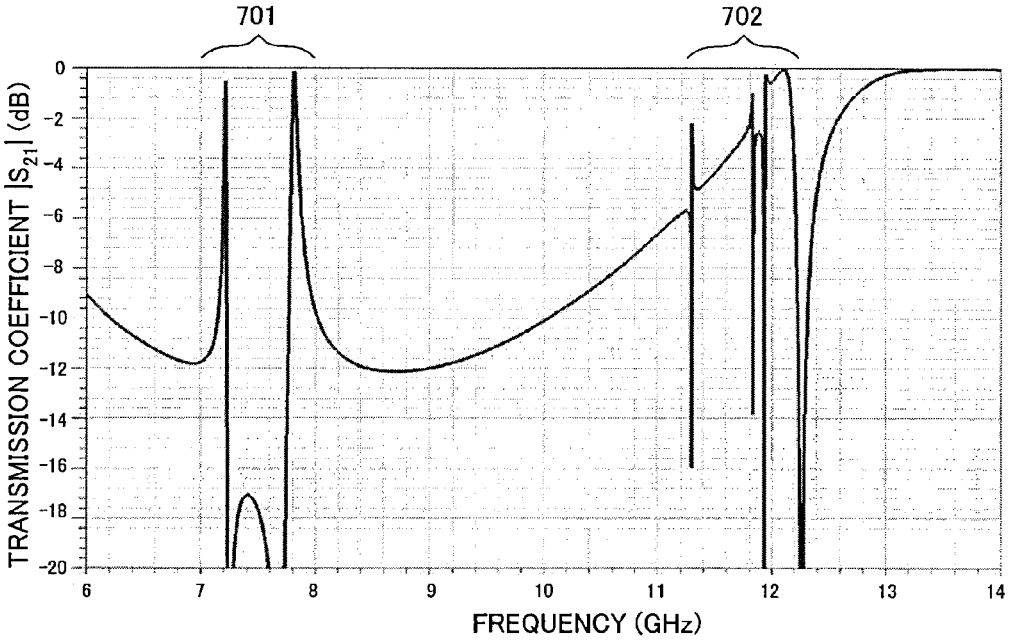
FIG. 7 is a graph showing the results of the simulation performed on the structure of FIG. 6.
Figure 8A:
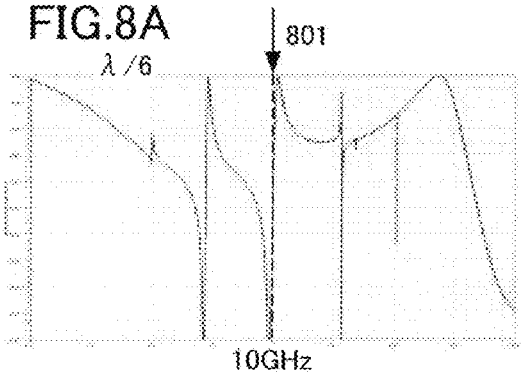
FIGS. 8A through 8E are graphs showing the transmission characteristics obtained in cases where the distance between the two dielectric structural components of FIG. 6 is varied.
Figure 8D:
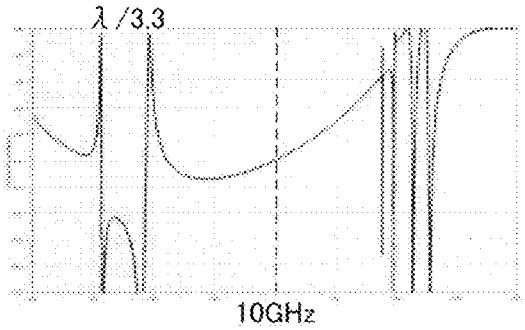
Figure 8B:
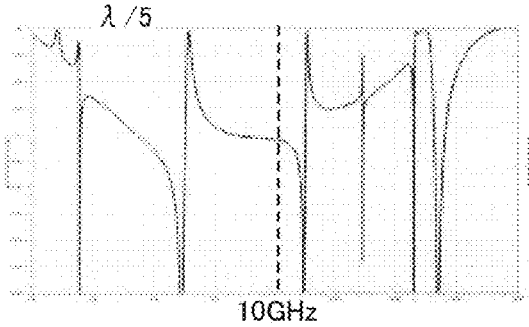
Figure 8E:
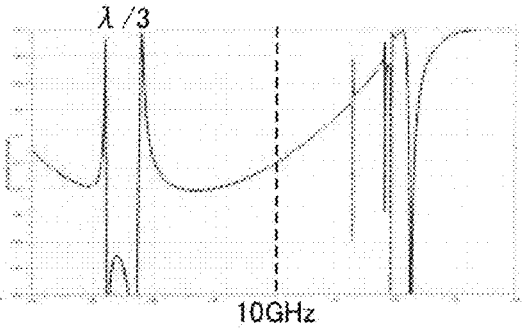
Figure 8C:
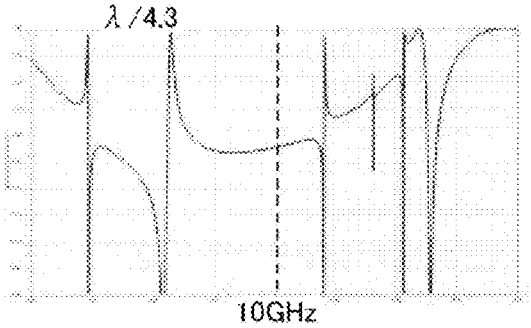
Figure 9A:
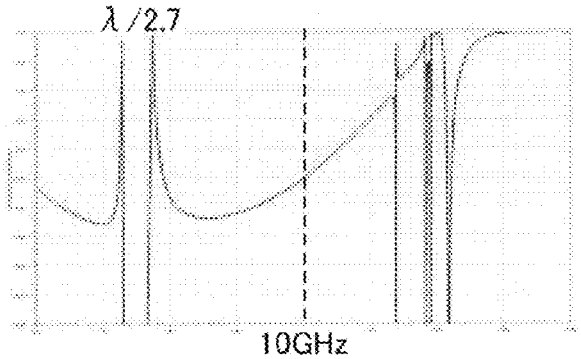
FIGS. 9A through 9D are graphs showing the transmission characteristics obtained in cases where the distance between the two dielectric structural components of FIG. 6 is varied.
Figure 9B:
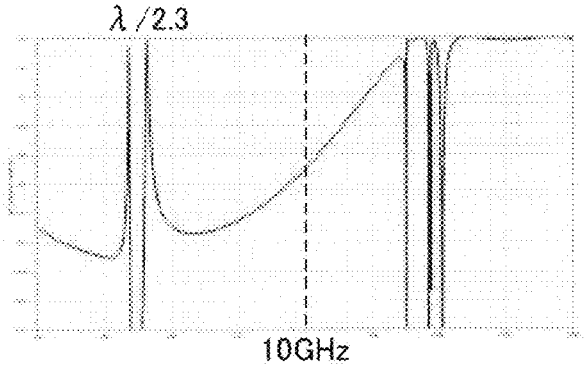
Figure 9C:
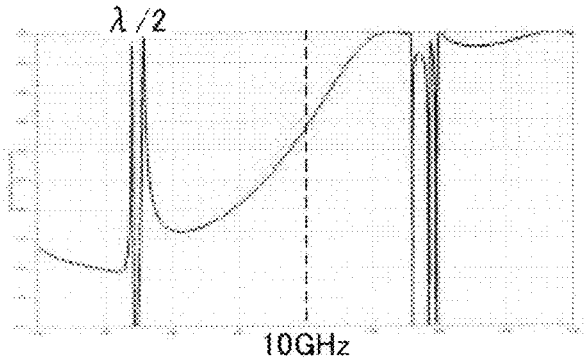
Figure 9D:
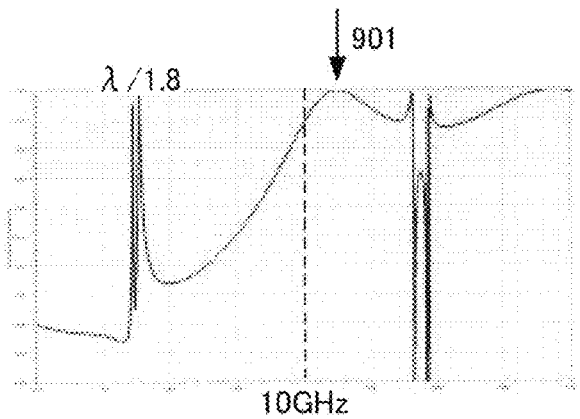

FIG. 7 is a graph showing the results of the simulation performed on the structure of FIG. 6. Specifically, FIG. 7 shows the results of a transmission characteristics calculation performed where the left and right surfaces 602 and 603 of the metal case 102 in FIG. 6 were used as the input and output ports.

In the graph of FIG. 7, the horizontal axis indicates frequency (6 to 14 GHz), and the vertical axis indicates the transmission coefficient $|S_{21}|$ (−20 to 0 dB) between the ports. A comparison between FIG. 7 and FIG. 5 shows that, as the number of dielectric structural components is increased from one to two, the two dielectric components are electromagnetically coupled to each other, and the transmission peaks 501 and 502 in FIG. 5 are turned into transmission peak groups 701 and 702 in FIG. 7. In addition, in the frequency band between the transmission peak groups 701 and 702, the transmission coefficient is even smaller than that in FIG. 5.

FIGS. 8A, 8B, 8C, 8D, 8E, 9A, 9B, 9C and 9D are graphs showing the transmission characteristics in cases where the distance 604 between the two dielectric structural components 601 shown in FIG. 6 is varied. The distance 604 in FIG. 6 is varied from λ/6 to λ/1.8 in terms of the electrical length of the 10 GHz center frequency. FIGS. 8A, 8B, 8C, 8D, and 8E show cases where the distance 604 is λ/6, λ/5, λ/4.3, λ/3.3, and λ/3, respectively. FIGS. 9A, 9B, 9C, and 9D show cases where the distance 604 is λ/2.7, λ/2.3, λ/2, and λ/1.8, respectively.

In cases where the distance 604 is λ/5 to λ/2, the transmission peaks resulting from the structural components 601 are far from the 10 GHz center frequency of the planar filters. As the distance 604 becomes shorter, the electromagnetic coupling between the structural components 601 becomes stronger, and the transmission peak groups 701 and 702 of FIG. 7 tend to spread. Where the distance 604 is λ/6, a transmission peak 801 (FIG. 8A) approximates the 10 GHz center frequency of the planar filter.

As the distance 604 becomes longer, on the other hand, the frequency of the cavity resonance between the structural components 601 tends to become lower. Where the distance 604 is λ/1.8, a transmission peak 901 (FIG. 9D) approximates the 10 GHz center frequency of the planar filter.

Accordingly, where the distance 604 is in the range of approximately λ/5 to λ/2, the transmission coefficient in regions near the center frequency of the planar filter can be reduced, without any hindrance from the resonance of the structural components 601 and without any hindrance from the cavity resonance between the structural components 601. More preferably, the distance 604 should be in the range of λ/4.3 to λ/2.3.

Figure 10A:
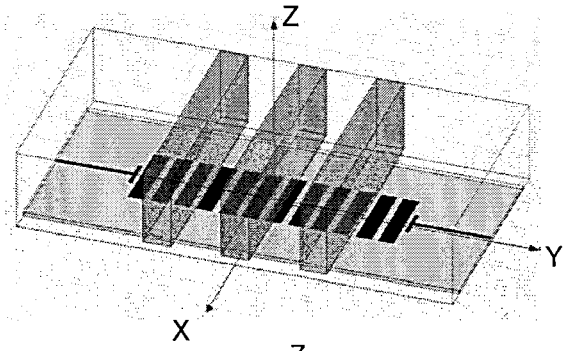
FIGS. 10A through 10C are perspective views of structures on which three-dimensional electromagnetic simulations are performed.
Figure 10B:
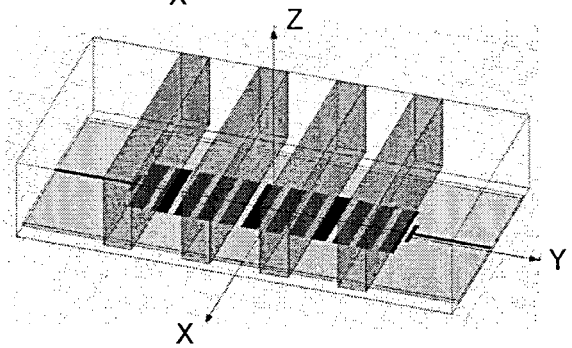
Figure 10C:
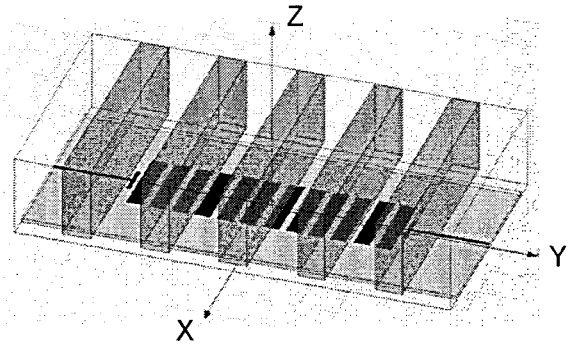

FIGS. 10A, 10B and 10C are perspective views of structures on which three-dimensional electromagnetic field simulations are performed. As shown in FIGS. 10A, 10B, and 10C, the number of structural components in the metal case is increased from three to four to five. The distance between each two adjacent dielectric structural components is λ/3.

Figure 11A:
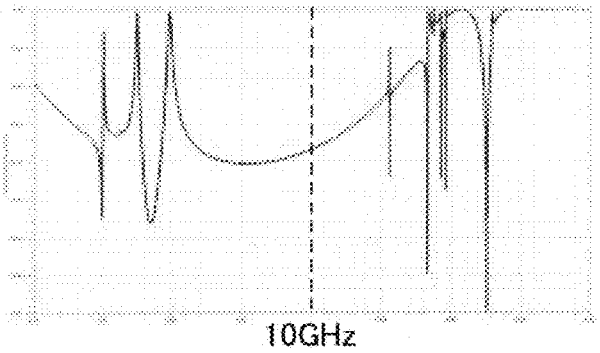
FIGS. 11A through 11C are graphs showing the results of the simulations performed on the structures of FIGS. 10A through 10C.
Figure 11B:
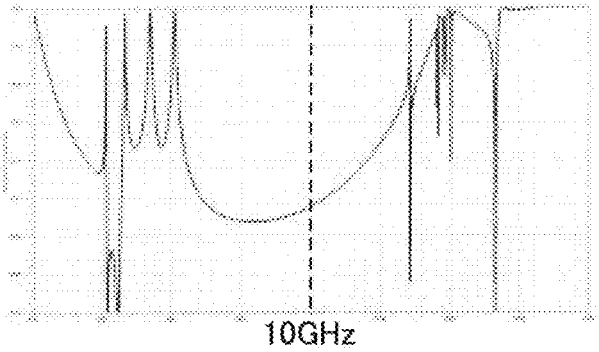
Figure 11C:
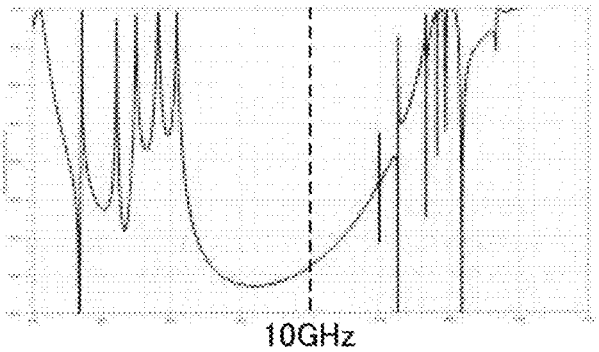

FIGS. 11A, 11B and 11C are graphs showing the results of the simulation performed on the structures of FIGS. 10A, 10B and 10C. Specifically, FIGS. 11A, 11B and 11C are graphs showing the results of transmission characteristics calculations performed where the left and right surfaces of the metal cases were used as the input/output ports. FIGS. 11A, 11B, and 11C correspond to the structures shown in FIGS. 10A, 10B, and 10C, respectively. In each of the graphs of FIGS. 11A, 11B and 11C, the horizontal axis indicates frequency (6 to 14 GHz), and the vertical axis indicates the transmission coefficient $|S_{21}|$ (−40 to 0 dB) between the ports.

As the number of structural components becomes larger, the transmission coefficient in regions near the 10 GHz center frequency of the planar filter becomes smaller, but the frequencies of the transmission peak groups resulting from the structural components hardly vary. In view of this, to effectively improve isolation between the input and the output, the distance between each two adjacent structural components should be λ/5 to λ/2, or more preferably about λ/3, and the number of structural components should be increased.

As described above, in a filter of this embodiment, plate-type dielectric structural components are arranged at predetermined intervals. Accordingly, propagation of electromagnetic waves in the metal case is suppressed, without adverse influence on the characteristics of the planar filter. Thus, a filter that has the original characteristics of a planar filter can be provided.

Second Embodiment

A filter of this embodiment differs from any filter of the first embodiment in that structural components including dielectric components provided in a metal case are stick-like dielectric components arranged in a direction perpendicular to the traveling direction of electromagnetic waves propagating from the input line to the output line or in a direction parallel to the wavefront of the standing wave generated by resonance inside the metal case. In the following, explanation of the same aspects as those of the first embodiment will not be repeated.

Figure 12:
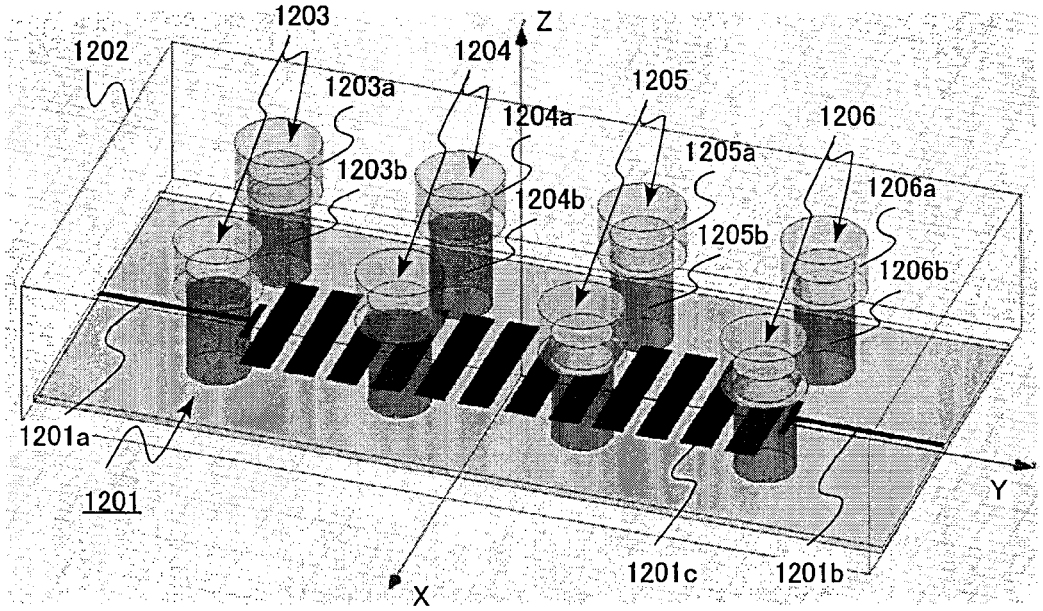
FIG. 12 is a perspective view of a filter according to a second embodiment.

FIG. 12 is a perspective view of a filter according to this embodiment. In FIG. 12, Z-direction is perpendicular to the X-direction and the Y-direction. The filter of this embodiment includes a planar filter 1201, a metal case 1202 housing the planar filter 1201, and structural component pairs 1203, 1204, 1205 and 1206 including dielectric components arranged inside the metal case 1202. Each of the structural component pairs 1203,1204, 1205 and 1206 is formed with two stick-like structural components. Here, two stick-like structural components are collectively referred to as a structural component pair. Extending direction of the stick-like structural components is the Z-direction.

The planar filter 1201 is formed using a microstrip-line planar filter substrate which has a ground plane at the lower surface, and a filter circuit pattern at the upper surface. The microstrip-line planar filter substrate is a dielectric substrate. The planar filter 1201 is a microstrip-line planar filter.

The planar filter 1201 includes an input line 1201*a* and an output line 1201*b* in left and right portions thereof. The planar filter 1201 is a 12-pole Chebyshev bandpass filter formed with twelve strip-type resonators 1201*c*, the input line 1201*a* and the output line 1201*b*. The center frequency $f_0$ of the filter is 10 GHz, for example.

Coaxial-microstrip connectors or the like are attached to the left and right ends of the metal case 1202, so that input and output extraction from the filter can be performed.

The structural component pairs 1203, 1204, 1205 and 1206 are arranged at intervals in the traveling direction (the Y-direction) of electromagnetic waves propagating from the input line 1201*a* to the output line 1201*b* of the filter in the metal case 1202 or in a direction perpendicular to the wavefront of the standing waves generated by the electromagnetic waves resonating inside the metal case 1202. Each of the intervals is approximately ⅕ to ½ wavelength in terms of the electrical length of the center frequency $f_0$ of the passband of the planar filter 1201. In this embodiment, each structural component pair is formed with two stick-like structural components. Upper thick portions 1203*a*, 1204*a*, 1205*a* and 1206*a* of the stick-like structural components are made of a metal, and lower thin portions 1203*b*, 1204*b*, 1205*b* and 1206*b* are dielectric components. Each two stick-like structural components are aligned in the direction (the X-direction) perpendicular to the traveling direction of electromagnetic waves propagating from the input line 1201*a* to the output line 1201*b* or in the direction parallel to the wavefront of the standing waves generated by resonance inside the metal case 1202.

The effects to be achieved from the above described structural components will be sequentially described below, based on the results of three-dimensional electromagnetic field simulations.

Figure 13:
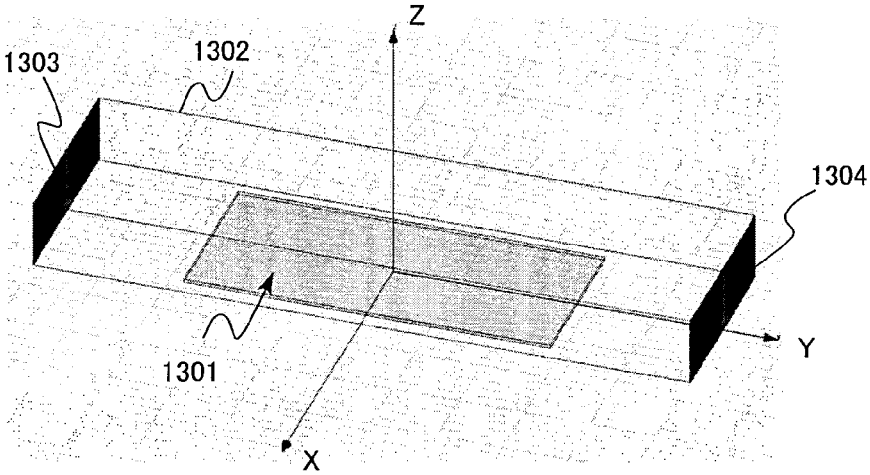
FIG. 13 is a perspective view of a structure on which a three-dimensional electromagnetic field simulation is performed.

FIG. 13 is a perspective view of a structure on which a three-dimensional electromagnetic simulation is performed. This structure includes a planar filter 1301 and a metal case 1302. This structure does not include any dielectric structural component in the metal case 1302. To clarify the distribution of electromagnetic waves, the metal case 1302 shown in FIG. 13 has a greater length than that of FIG. 12. The same applies to the filter structures described later on which simulations are performed.

Figure 14:
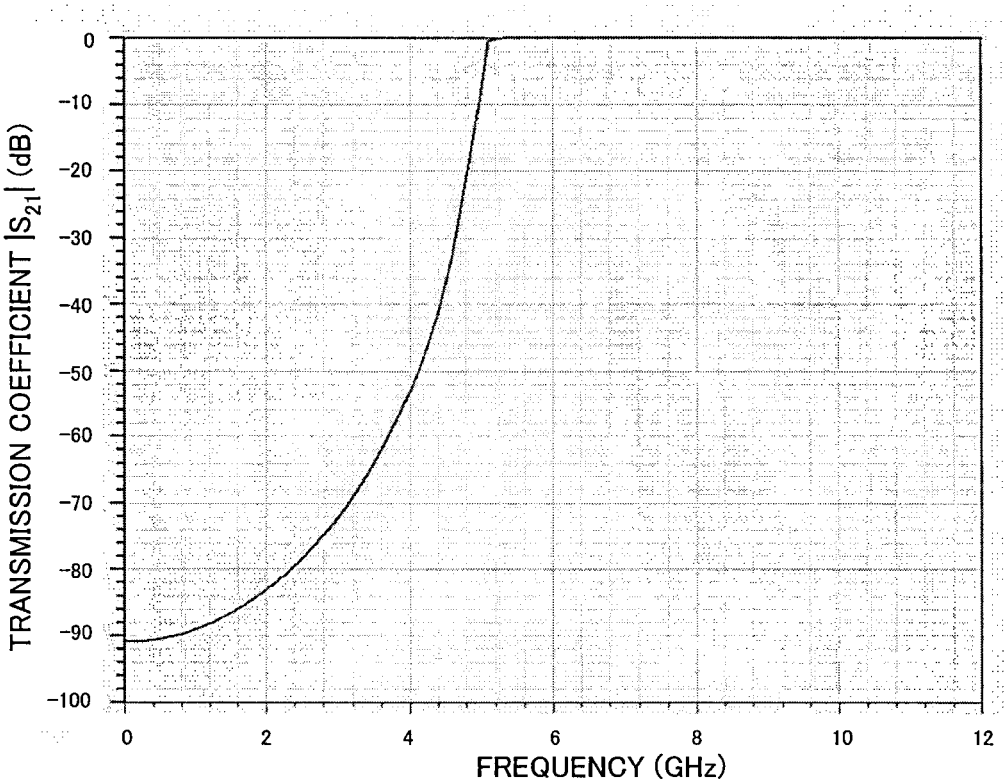
FIG. 14 is a graph showing the results of the simulation performed on the structure of FIG. 13.

FIG. 14 is a graph showing the results of the simulation performed on the structure of FIG. 13. Specifically, FIG. 14 shows the results of a transmission characteristics calculation performed where the left and right surfaces 1303 and 1304 of the metal case 1302 in FIG. 13 were used as the input and output ports. In the graph of FIG. 14, the horizontal axis indicates frequency (0 to 12 GHz), and the vertical axis indicates the transmission coefficient $|S_{21}|$ (−100 to 0 dB) between the ports.

The cutoff frequency of this metal case 1302 is approximately 5 GHz, and substantially all-pass characteristics are achieved above the cutoff frequency.

Figure 15:
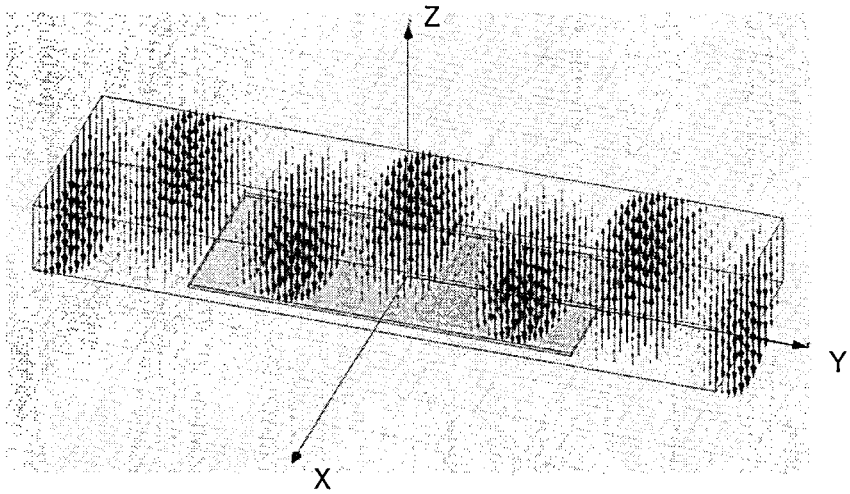
FIG. 15 is a diagram showing the electrical field distribution in the metal case at 10 GHz simulated on the structure of FIG. 13.

FIG. 15 is a diagram showing the electrical field distribution in the metal case 1302 at 10 GHz simulated on the structure of FIG. 13. Although not apparent from this diagram alone, the results of observation carried out to measure changes in the electrical field vector by varying the input phase on a simulation show that this electrical field is waves traveling from left to right in FIG. 15.

Figure 16:
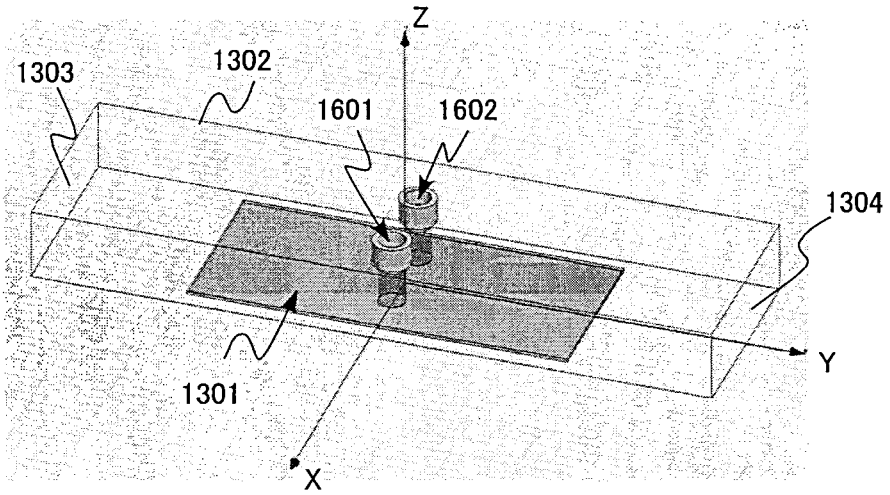
FIG. 16 is a perspective view of a structure on which a three-dimensional electromagnetic field simulation is performed.

FIG. 16 is a perspective view of a structure on which a three-dimensional electromagnetic field simulation is performed. In this structure, two stick-like structural components 1601 and 1602 are arranged in the direction perpendicular to the traveling direction of electromagnetic waves in the metal case 1302.

Figure 17:
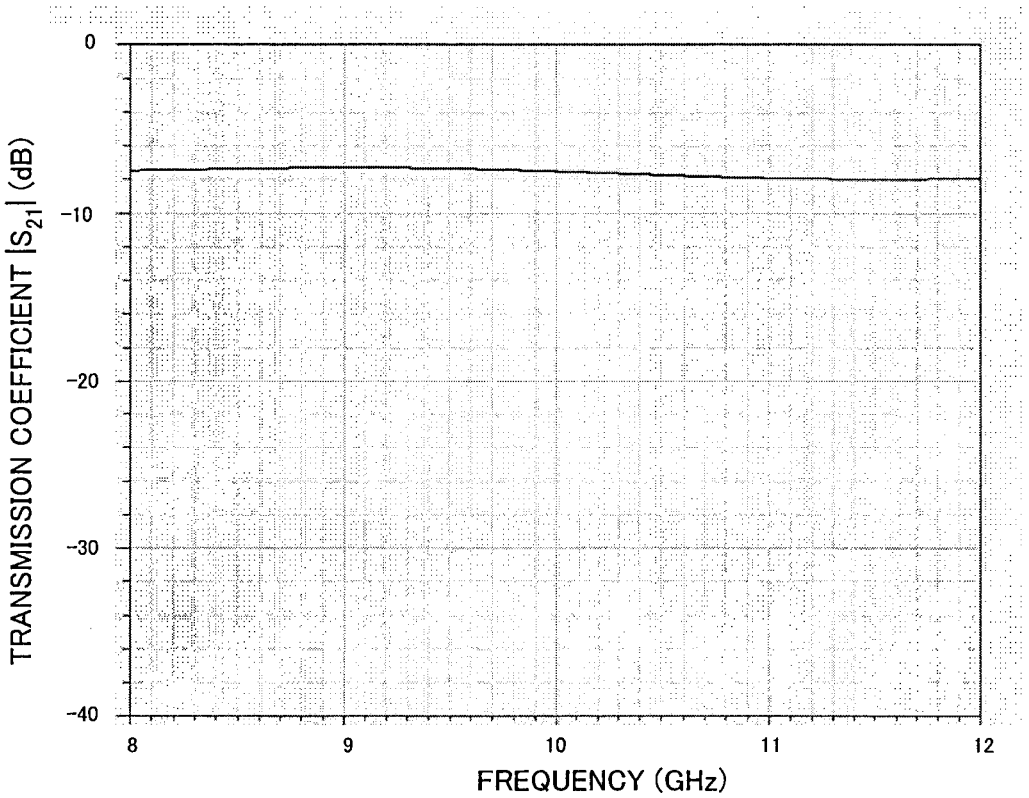
FIG. 17 is a graph showing the results of the simulation performed on the structure of FIG. 16.

FIG. 17 is a graph showing the results of the simulation performed on the structure of FIG. 16. Specifically, FIG. 17 shows the results of a transmission characteristics calculation performed where the left and right surfaces 1303 and 1304 of the metal case 1302 in FIG. 16 were used as the input and output ports. In the graph of FIG. 17, the horizontal axis indicates frequency (8 to 12 GHz), and the vertical axis indicates the transmission coefficient $|S_{21}|$ (−40 to 0 dB) between the ports.

As the two structural components are provided, the transmission coefficient is lowered to approximately −8 dB.

Figure 18:
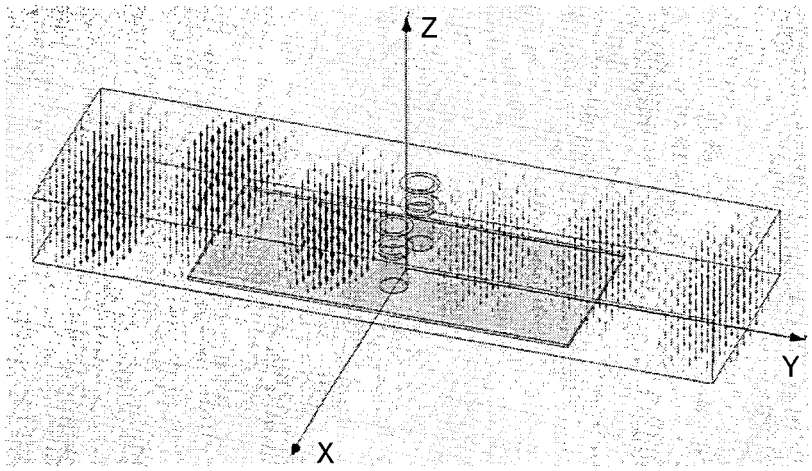
FIG. 18 is a diagram showing the electrical field distribution in the metal case at 10 GHz simulated on the structure of FIG. 16.

FIG. 18 is a diagram showing the electrical field distribution in the metal case 1302 at 10 GHz simulated on the structure of FIG. 16. Although not apparent from this diagram alone, the results of observation carried out to measure changes in the electrical field vector by varying the input phase with a computer show that this electrical field is standing waves in the area on the left side of the structural components, and is rightward traveling waves in the area on the right side of the structural components. The transmission coefficient is lowered to approximately −8 dB, because electromagnetic waves are reflected by the plane (the X-Z plane) in which the two structural components are aligned.

Figure 19:
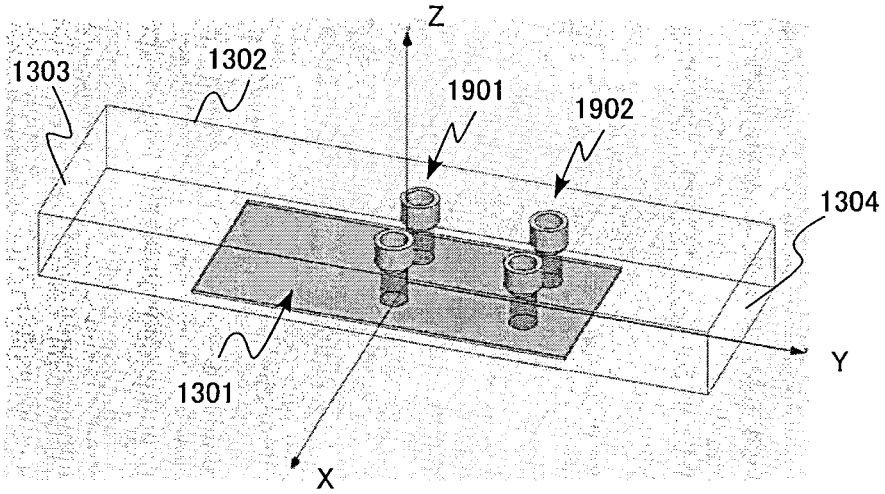
FIG. 19 is a perspective view of a structure on which a three-dimensional electromagnetic field simulation is performed.

FIG. 19 is a perspective view of a structure on which a three-dimensional electromagnetic field simulation is performed. In this structure, two stick-like structural component pairs 1901 and 1902 are placed, so that two reflection planes are formed in the metal case 1302, and a cavity structure is formed. The distance between the two stick-like structural component pairs in the traveling direction of electromagnetic waves is approximately λ/1.5, which is an electrical length at the center frequency (10 GHz) of the planar filter.

Figure 20:
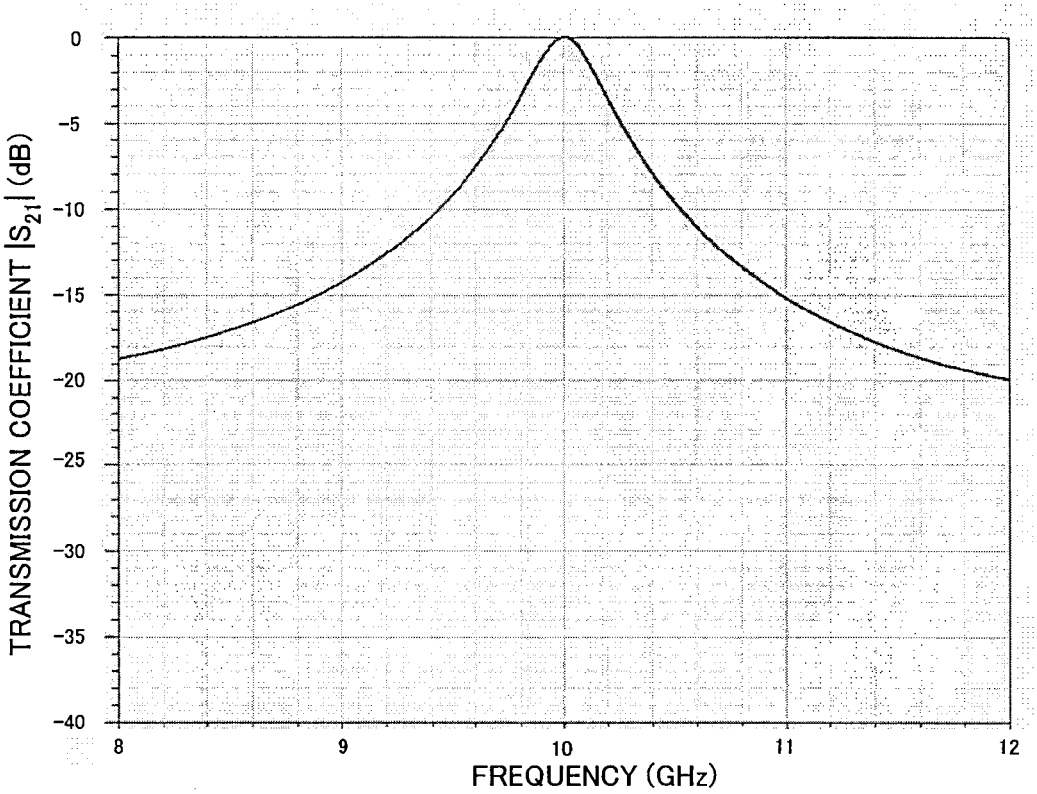
FIG. 20 is a graph showing the results of the simulation performed on the structure of FIG. 19.

FIG. 20 is a graph showing the results of the simulation performed on the structure of FIG. 19. Specifically, FIG. 20 shows the results of a transmission characteristics calculation performed where the left and right surfaces 1303 and 1304 of the metal case 1302 in FIG. 19 were used as the input and output ports. In the graph of FIG. 20, the horizontal axis indicates frequency (8 to 12 GHz), and the vertical axis indicates the transmission coefficient $|S_{21}|$ (−40 to 0 dB).

Figure 21:
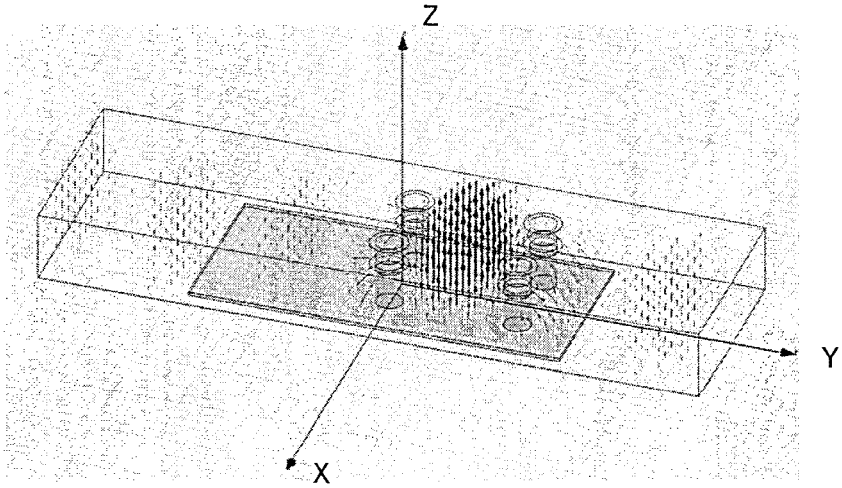
FIG. 21 is a diagram showing the electrical field distribution in the metal case at 10 GHz simulated on the structure of FIG. 19.

FIG. 21 is a diagram showing the electrical field distribution in the metal case 1302 at 10 GHz simulated on the structure of FIG. 19. As can be seen from the drawing, electromagnetic waves travel back and forth between the two reflection planes and resonate in such a mode that the electrical field concentrates between the structural components, since the two reflection planes are formed by the two stick-like structural component pairs arranged in the direction perpendicular to the propagating direction of the electromagnetic waves.

Figure 22:
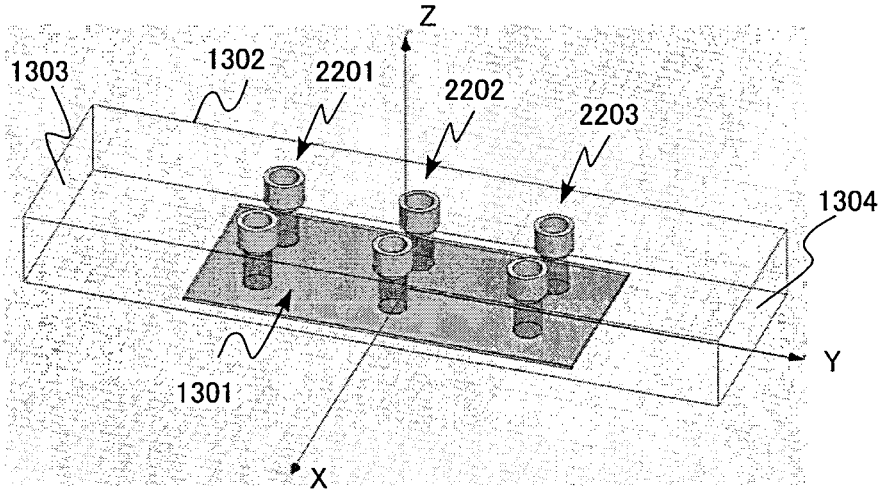
FIG. 22 is a perspective view of a structure on which a three-dimensional electromagnetic field simulation is performed.

FIG. 22 is a perspective view of a structure on which a three-dimensional electromagnetic field simulation is performed. In this structure, three stick-like structural component pairs 2201, 2202, and 2203 are placed in the metal case 1302, to form two cavity structures in the waveguide. The distance between each two adjacent stick-like structural component pairs in the traveling direction of electromagnetic waves is approximately λ/1.5, which is an electrical length at the center frequency (10 GHz) of the planar filter.

Figure 23:
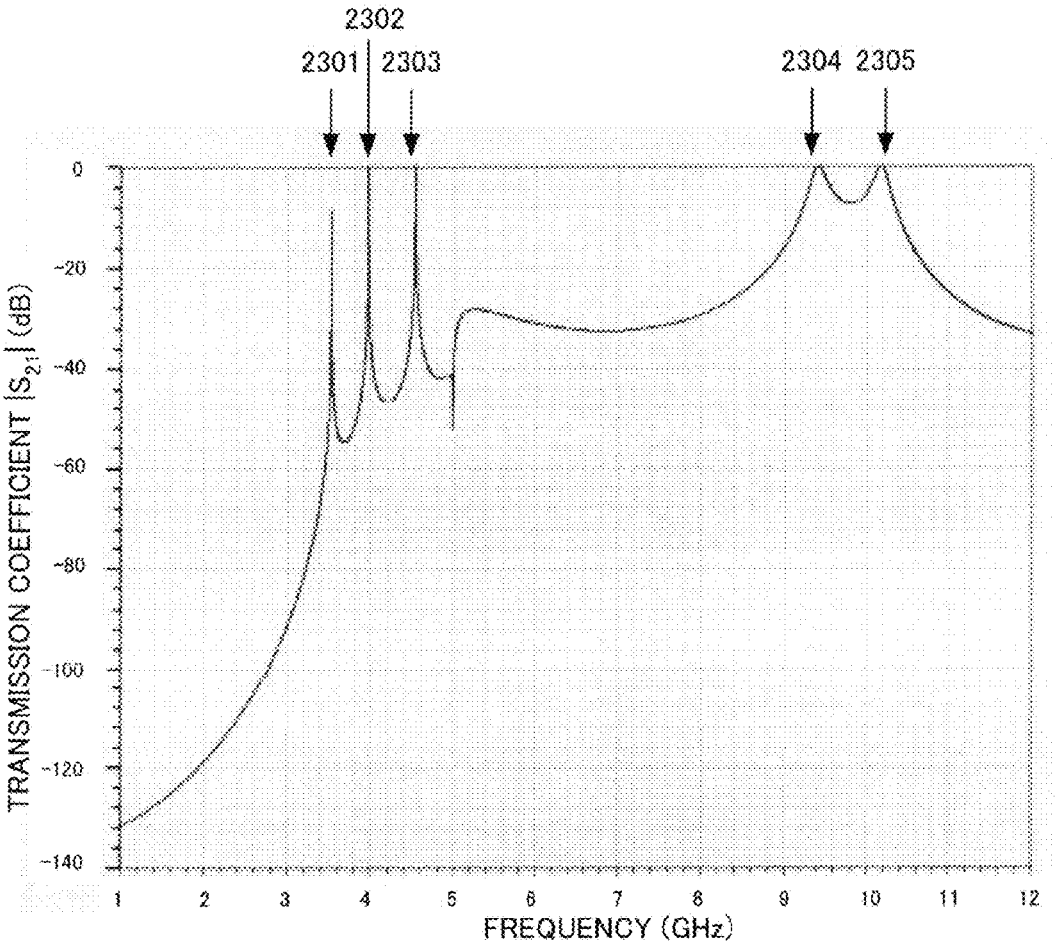
FIG. 23 is a graph showing the results of the simulation performed on the structure of FIG. 22.
Figure 24:
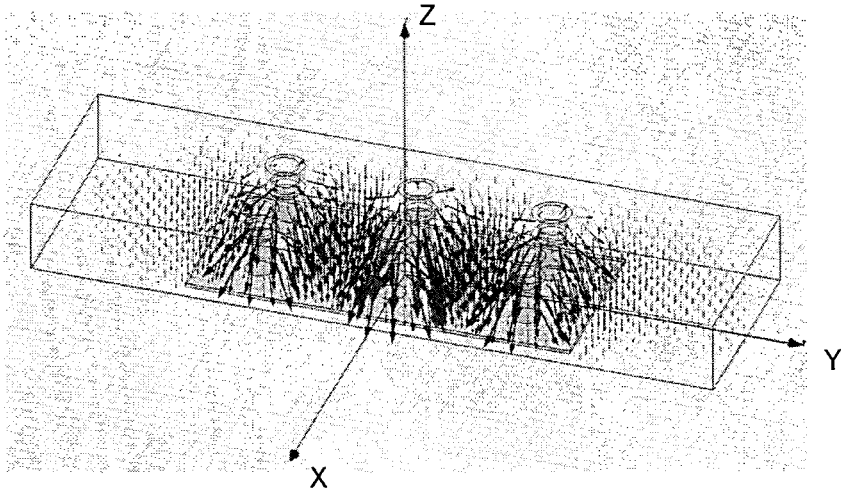
FIG. 24 is a diagram showing the electrical field distribution at a resonance peak shown in the graph of FIG. 23.
Figure 25:
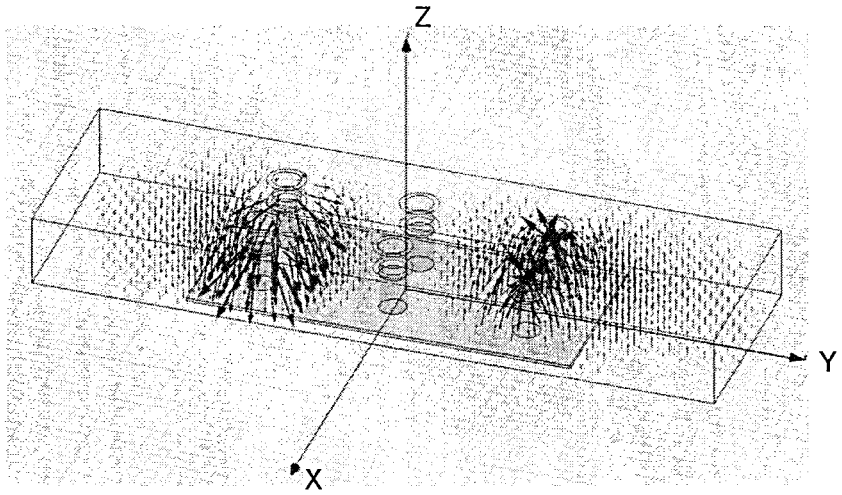
FIG. 25 is a diagram showing the electrical field distribution at a resonance peak shown in the graph of FIG. 23.
Figure 26:
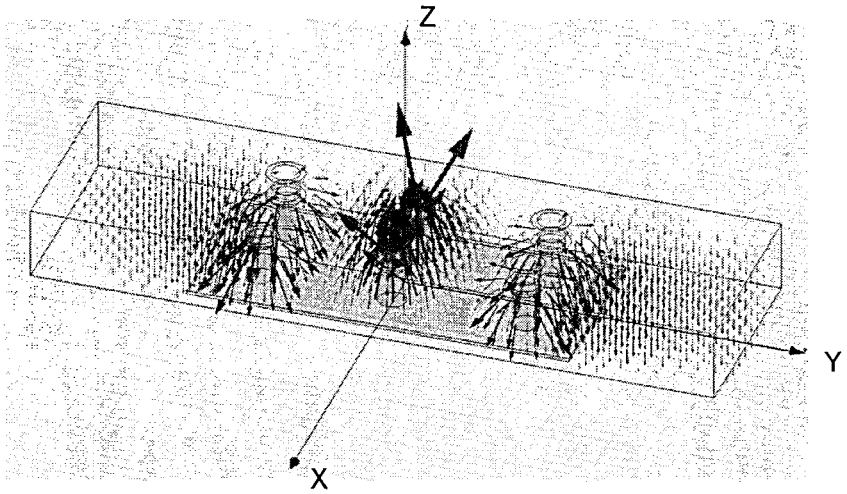
FIG. 26 is a diagram showing the electrical field distribution at a resonance peak shown in the graph of FIG. 23.
Figure 27:
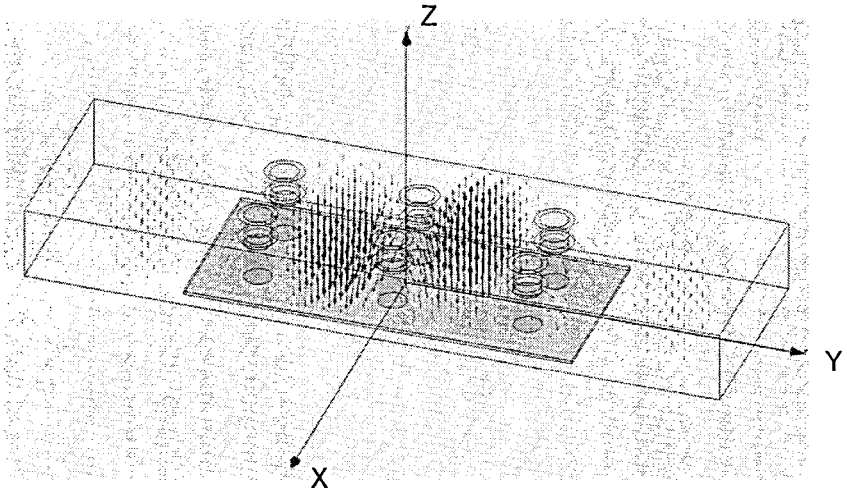
FIG. 27 is a diagram showing the electrical field distribution at a resonance peak shown in the graph of FIG. 23.
Figure 28:
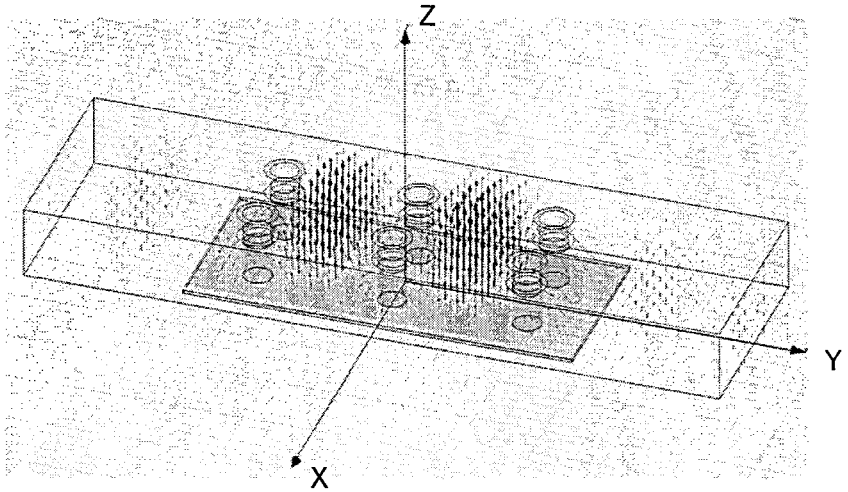
FIG. 28 is a diagram showing the electrical field distribution at a resonance peak shown in the graph of FIG. 23.

FIG. 23 is a graph showing the results of the simulation performed on the structure of FIG. 22. Specifically, FIG. 23 shows the results of a transmission characteristics calculation performed where the left and right surfaces 1303 and 1304 of the metal case 1302 in FIG. 22 were used as the input and output ports. In the graph of FIG. 23, the horizontal axis indicates frequency (1 to 12 GHz), and the vertical axis indicates the transmission coefficient $|S_{21}|$ (−140 to 0 dB).

As can be seen from the graph of FIG. 23, there are two peaks 2304 and 2305 in regions near 10 GHz, and there are three peaks 2301, 2302, and 2303 between 3 GHz and 5 GHz.

FIGS. 24, 25, 26, 27 and 28 are diagrams showing the electrical field distributions at the resonance peaks 2301, 2302, 2303, 2304 and 2305 in the graph of FIG. 23, respectively. As is apparent from FIGS. 24, 25, 26, the three resonance peaks 2301, 2302, and 2303 are formed, because each of the stick-like structural component pairs itself works as a resonator and resonates. Also, the electrical field distribution patterns ("↓↓↓" in FIG. 24, "↓0↑" in FIG. 25, and "↓↑↓" in FIG. 26) are typical patterns in cases where each of those three resonators is coupled to each adjacent resonator. In addition, as can be seen from FIGS. 27 and 28, the resonance peaks 2304 and 2305 indicate resonant modes in which the area between each two adjacent structural component pairs functions as a cavity.

The relationship between the number of structural component pairs and the transmission coefficient is as follows. FIGS. 29A, 29B, 29C, 29D and 29E are perspective views of structures on which three-dimensional electromagnetic field simulations are performed. FIGS. 29A, 29B, 29C, 29D and 29E illustrate cases where the number of stick-like structural component pairs is varied from one to five. The distance between each two adjacent stick-like structural component pairs in the traveling direction of electromagnetic waves is approximately λ/2.5 in terms of an electrical length at the center frequency (10 GHz) of the planar filter.

FIGS. 30A, 30B, 30C, 30D and 30E are graphs showing the results of the simulations performed on the structures of FIGS. 29A, 29B, 29C, 29D and 29E. FIGS. 30A, 30B, 30C, 30D and 30E shows the calculation results corresponding to FIGS. 29A, 29B, 29C, 29D and 29E, respectively. Specifically, FIGS. 30A, 30B, 30C, 30D and 30E show the results of transmission characteristics calculations performed where the left and right surfaces 1303 and 1304 of the metal case 1302 were used as the input and output ports. In each of the graphs of FIGS. 30A, 30B, 30C, 30D and 30E, the horizontal axis indicates frequency (8 to 12 GHz), and the vertical axis indicates the transmission coefficient $|S_{21}|$ (−100 to 0 dB).

As can be seen from FIGS. 30A, 30B, 30C, 30D and 30E, as the number of structural component pairs becomes larger, the decrease in the transmission coefficient can be made larger, and the isolation between the input and the output of the filter can be improved. In addition, as each structural component is formed with two stick-like structural components, there are fewer high-order resonant modes than in the case of plate-like structural components. Accordingly, frequency domains with high degrees of isolation can be widened.

Figure 29A:
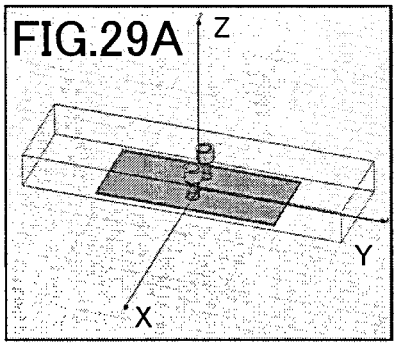
FIGS. 29A through 29E are perspective views of structures on which three-dimensional electromagnetic field simulations are performed.
Figure 29B:
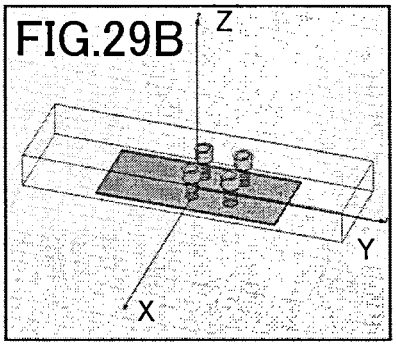
Figure 29C:
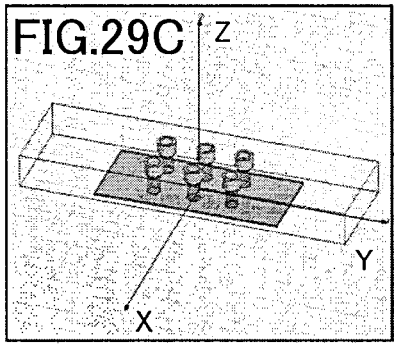
Figure 29D:
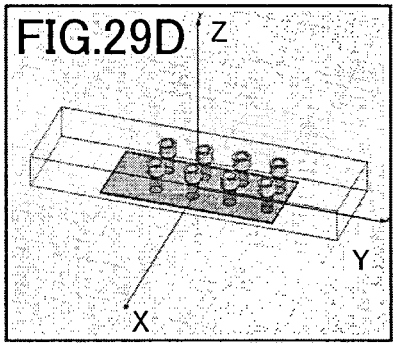
Figure 29E:
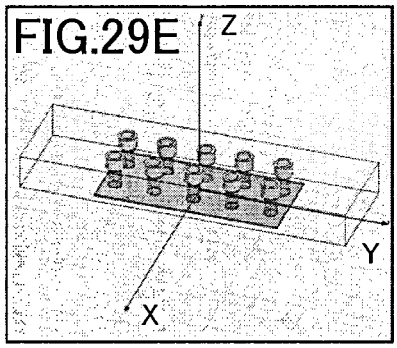
Figures 30A, 30B, 30C, 30D, 30E:
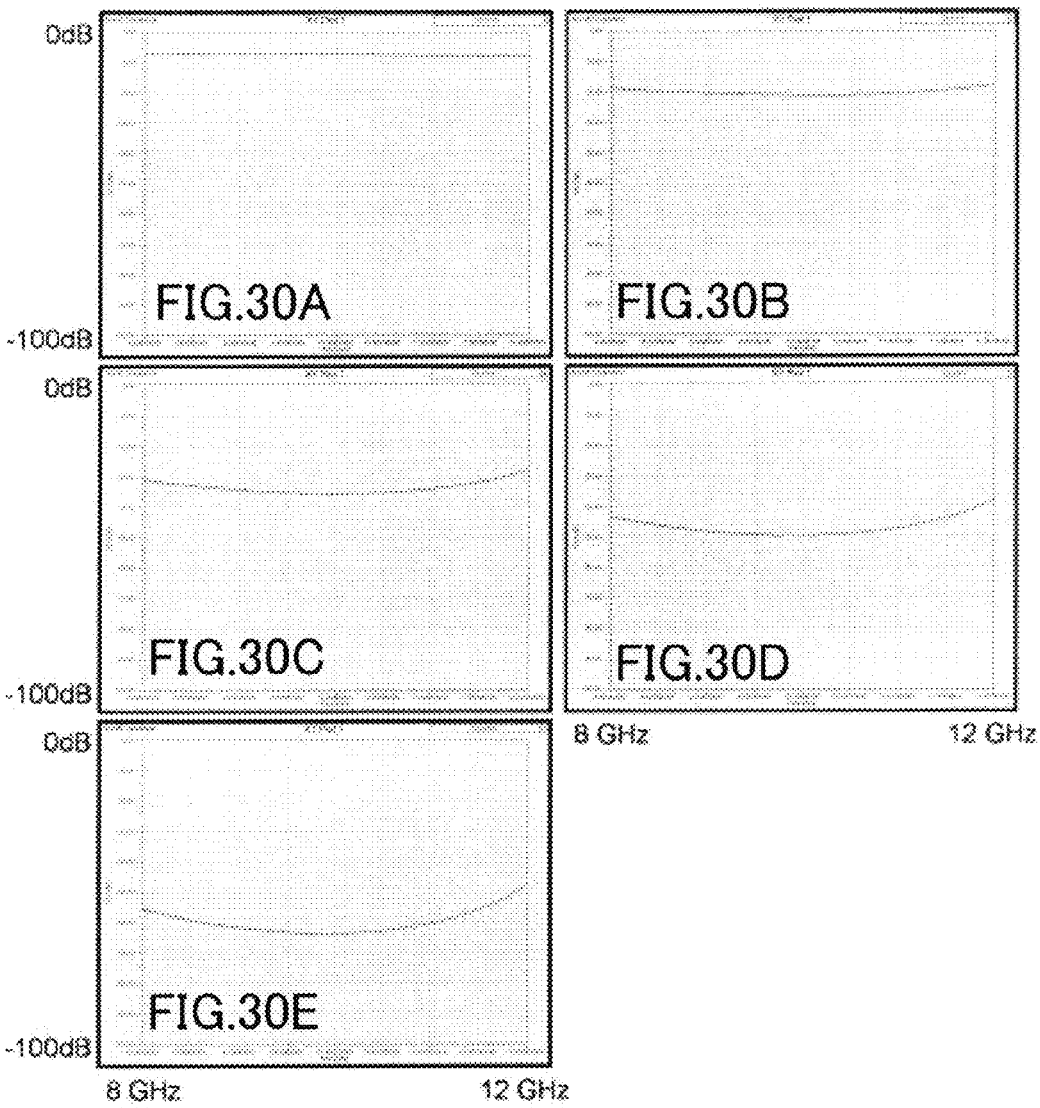
FIGS. 30A through 30E are graphs showing the results of the simulations performed on the structures of FIGS. 29A through 29E.
Figure 31:
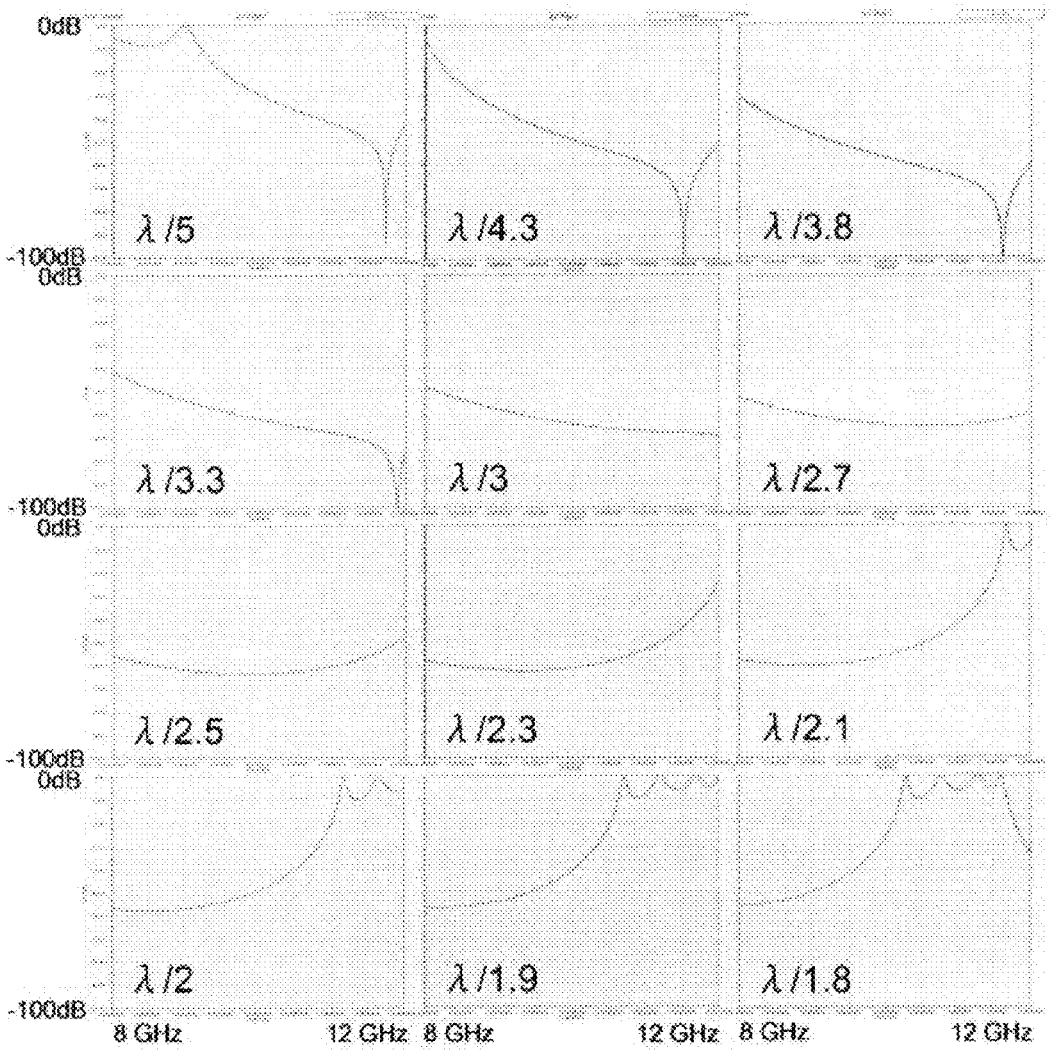
FIG. 31 is a graph showing the results of simulations performed where the distance between structural component pairs is varied for the structure shown in FIG. 29E.

FIG. 31 shows the results of simulations performed where the distance between each two adjacent structural component pairs is varied for the structure shown in FIG. 29E. Specifically, FIG. 31 shows the results of transmission characteristics calculations performed where the distance between each two adjacent structural component pairs is varied at intervals of λ/5, λ/4.3, λ/3.8, λ/3.3, λ/3, λ/2.7, λ/2.5, λ/2.3, λ/2.1, λ/2, λ/1.9 and λ/1.8 in terms of the electrical length of the center frequency (10 GHz) of the planar filter, with the number of structural component pairs being five. In each of the graphs of FIG. 31, the horizontal axis indicates frequency (8 to 12 GHz), and the vertical axis indicates the transmission coefficient $|S_{21}|$ (−100 to 0 dB).

In cases where the distance between each two adjacent structural component pairs is short, resonance peaks appear on the low-frequency side. In cases where the distance between each two adjacent structural component pairs is long, resonance peaks appear on the high-frequency side. As described above, the resonance peaks on the low-frequency side indicate resonant modes in which the structural component pairs function as resonators. The resonance peaks on the high-frequency side indicate resonant modes in which the areas between the structural component pairs function as resonators. Where the distance between each two adjacent structural component pairs is λ/5 to λ/2, there are regions in which the decrease in the transmission coefficient is large in the vicinity of 10 GHz, which is the center frequency of the planar filter. Accordingly, the isolation between the input and the output of the filter can be improved.

As described above, in a filter of this embodiment, stick-like dielectric structural components are arranged at predetermined intervals. Accordingly, electromagnetic wave propagation in the metal case is suppressed, without adverse influence on the characteristics of the planar filter. Thus, a filter that has the original characteristics of a planar filter can be provided. Particularly, as each structural component is formed with two stick-like structural components, there are fewer high-order resonant modes than in the case of plate-like structural components. Accordingly, frequency regions with high degrees of isolation can be widened, and electromagnetic wave propagation in the metal cases can be more easily suppressed.

Third Embodiment

A filter of this embodiment includes: a microstrip-line planar filter that includes an input line, resonators, and an output line, and has a passband with a center frequency $f_0$; a metal case housing the planar filter; and structural components including dielectric components that are arranged at an interval in the traveling direction of electromagnetic waves from the input line to the output line or in a direction perpendicular to the wavefront of the standing waves generated by the electromagnetic waves resonating in the metal case. The interval is ⅕ to ½ wavelength in terms of the electrical length of the center frequency $f_0$.

The structural components include dielectric components arranged in a direction perpendicular to the traveling direction of electromagnetic waves or in a direction parallel to the wavefront of standing waves. The dielectric components are six stick-like dielectric components in this embodiment. The six stick-like dielectric components are arranged at intervals of ⅕ to ½ wavelength in terms of the electrical length of the center frequency $f_0$.

The structural components have moving mechanisms that move the stick-like dielectric components up and down in the longitudinal direction. The stick-like dielectric components are arranged immediately above the resonators. Each of the moving mechanisms includes a metal portion connected to the dielectric component, and the metal portion protrudes from the metal case. When part of the protruding metal portion is rotated, the corresponding dielectric component can be moved in the longitudinal direction of the stick. As the stick-like dielectric components are moved up and down, the center frequencies of the resonators can be adjusted.

Further, the conductor portion of the planar filter substrate is made of a superconductor.

Figure 32:
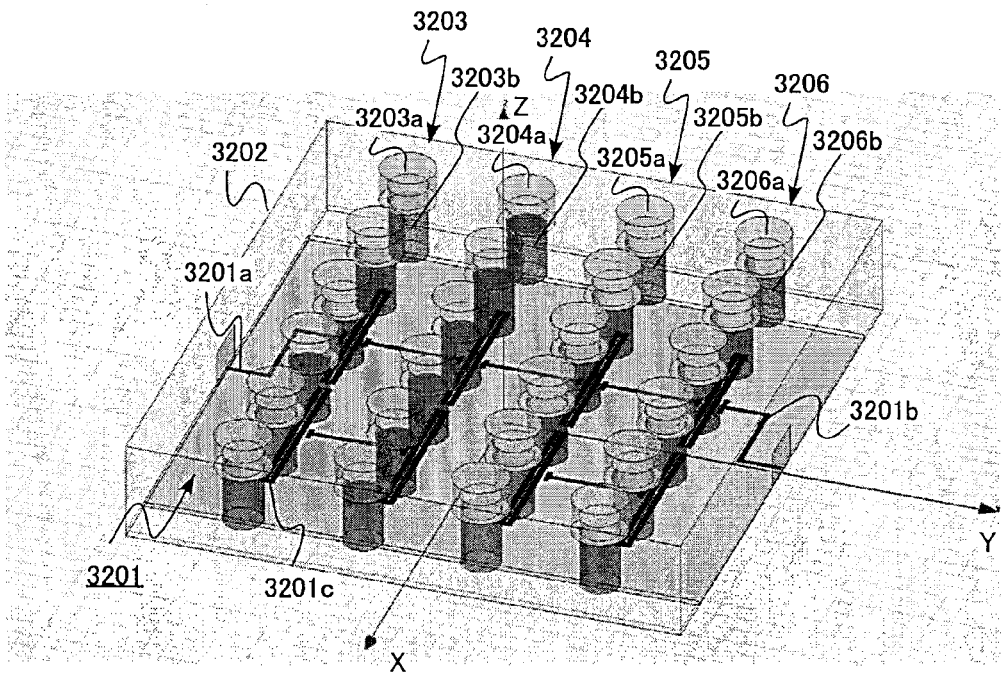
FIG. 32 is a perspective view of a filter according to a third embodiment.

FIG. 32 is a perspective view of a filter of this embodiment. The filter of this embodiment includes a planar filter 3201, a metal case 3202 housing the planar filter 3201, and structural components 3203, 3204, 3205, and 3206 including dielectric components arranged in the metal case 3202.

The planar filter 3201 is formed using a microstrip-line planar filter substrate which has a ground plane at the lower surface, and a filter circuit pattern at the upper surface. The microstrip-line planar filter substrate is a dielectric substrate. The planar filter 3201 is a microstrip-line planar filter.

The planar filter 3201 includes an input line 3201*a* and an output line 3201*b* in left and right portions thereof. The planar filter 3201 is an 8-pole pseudo-elliptical function bandpass filter formed with eight hairpin resonators 3201*c*, the input line 3201*a* and the output line 3201*b*. The center frequency $f_0$ of the filter is 10 GHz.

Coaxial-microstrip connectors or the like are attached to the left and right ends of the metal case 3202, so that input and output extraction from the filter can be performed.

Each of the structural components 3203, 3204, 3205, and 3206 is formed with six stick-like structural components. The structural components 3203, 3204, 3205, and 3206 are arranged at intervals in the traveling direction (the Y-direction) of electromagnetic waves propagating from the input line 3201*a* to the output line 3201*b* of the filter in the metal case 3202 or in a direction perpendicular to the wavefront of the standing waves generated by the electromagnetic waves resonating inside the metal case 3202. Each of the intervals is approximately ⅕ to ½ wavelength in terms of the electrical length of the center frequency $f_0$ of the passband of the planar filter 3201. The upper thick portions 3203*a*, 3204*a*, 3205*a* and 3206*a* of the stick-like structural components are made of a metal, and the lower thin portions 3203*b*, 3204*b*, 3205*b* and 3206*b* are dielectric components.

The effects to be achieved from the above described structural components will be sequentially described below, based on the results of three-dimensional electromagnetic field simulations.

Figure 33:
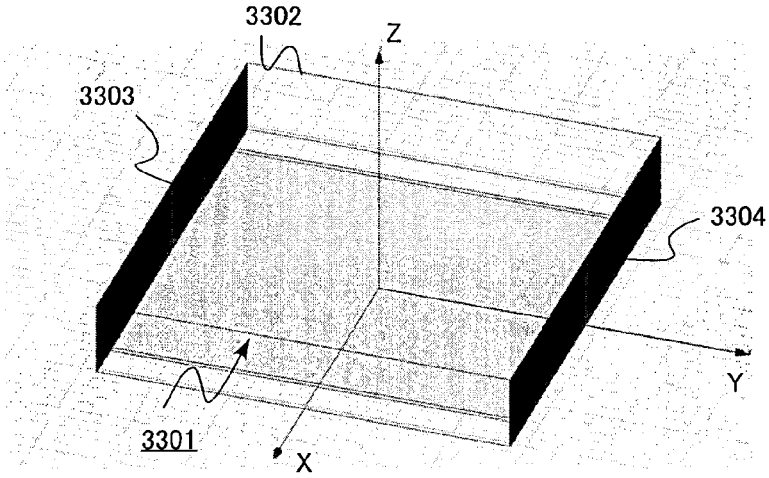
FIG. 33 is a perspective view of a structure on which a three-dimensional electromagnetic field simulation is performed.

FIG. 33 is a perspective view of a structure on which a three-dimensional electromagnetic simulation is performed. In this structure, a planar filter 3301 is housed by a metal case 3302, and dielectric structural components are not provided in the metal case 3302 in FIG. 33. The filter circuit pattern of the planar filter 3301 is not shown.

Figure 34:
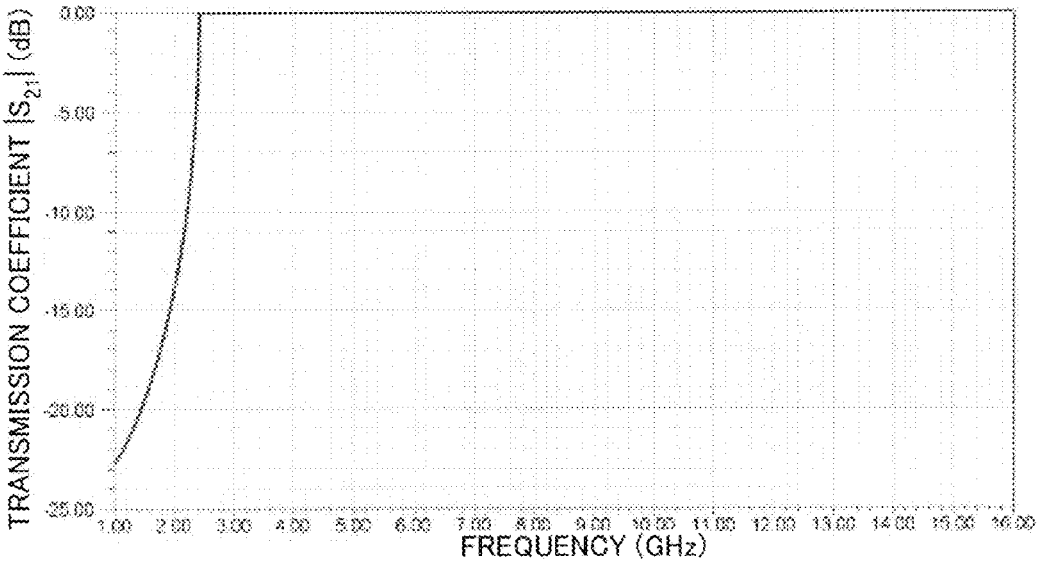
FIG. 34 is a graph showing the results of the simulation performed on the structure of FIG. 33.

FIG. 34 is a graph showing the results of the simulation performed on the structure of FIG. 33. Specifically, FIG. 34 shows the results of a transmission characteristics calculation performed where the left and right surfaces 3303 and 3304 of the metal case 3302 were used as the input and output ports. In the graph of FIG. 34, the horizontal axis indicates frequency (1 to 16 GHz), and the vertical axis indicates the transmission coefficient $|S_{21}|$ (−25 to 0 dB) between the ports.

The cutoff frequency of this metal case 3302 is approximately 2.4 GHz, and substantially all-pass characteristics are achieved above the cutoff frequency.

Figure 35:
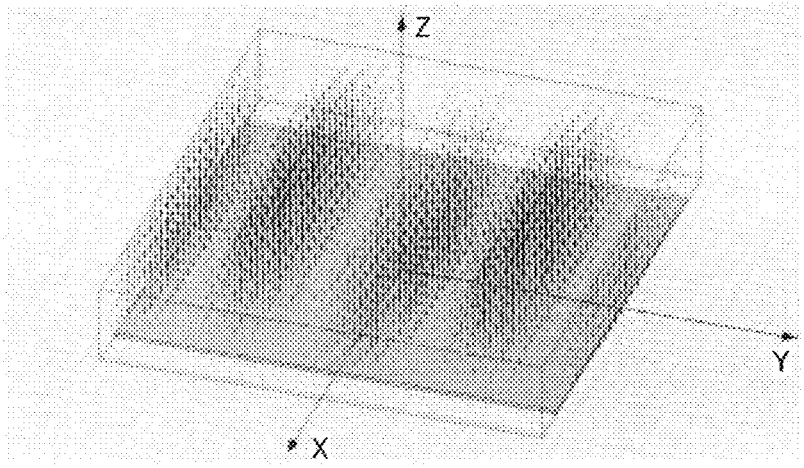
FIG. 35 is a diagram showing the electrical field distribution in the metal case at 10 GHz simulated on the structure of FIG. 33.

FIG. 35 is a diagram showing the electrical field distribution in the metal case 3302 at 10 GHz simulated on the structure of FIG. 33. Although not apparent from this diagram alone, the results of observation carried out to measure changes in the electrical field vector by varying the input phase on a simulation show that this electrical field is waves traveling from left to right in FIG. 35.

Figure 36:
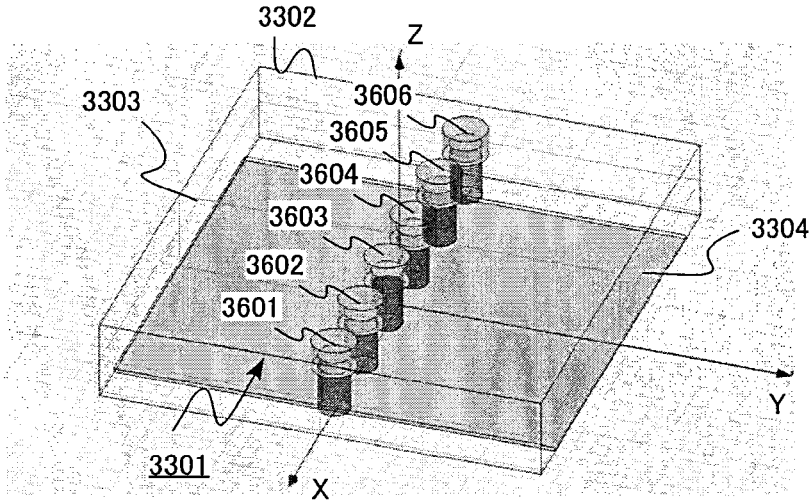
FIG. 36 is a perspective view of a structure on which a three-dimensional electromagnetic field simulation is performed.

FIG. 36 is a perspective view of a structure on which a three-dimensional electromagnetic field simulation is performed. In this structure, six stick-like dielectric structural components 3601, 3602, 3603, 3604, 3605, and 3606 are arranged in the direction perpendicular to the traveling direction of electromagnetic waves in the metal case 3302. The distance of each two adjacent stick-like structural components in the direction perpendicular to the traveling direction of electromagnetic waves is approximately λ/3. The filter circuit pattern of the planar filter 3301 is not shown.

Figure 37:
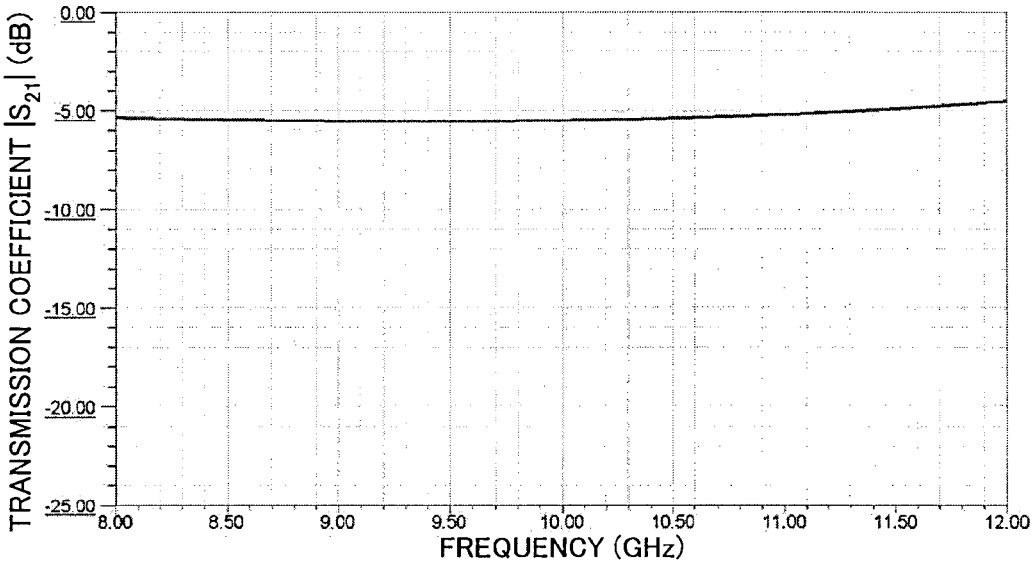
FIG. 37 is a graph showing the results of the simulation performed on the structure of FIG. 36.

FIG. 37 is a graph showing the results of the simulation performed on the structure of FIG. 36. Specifically, FIG. 37 shows the results of a transmission characteristics calculation performed where the left and right surfaces 3303 and 3304 of the metal case 3302 in FIG. 36 were used as the input and output ports. In the graph of FIG. 37, the horizontal axis indicates frequency (8 to 12 GHz), and the vertical axis indicates the transmission coefficient $|S_{21}|$ (−25 to 0 dB) between the ports.

As the six structural components are provided, the transmission coefficient is lowered to approximately −5 dB.

Figure 38:
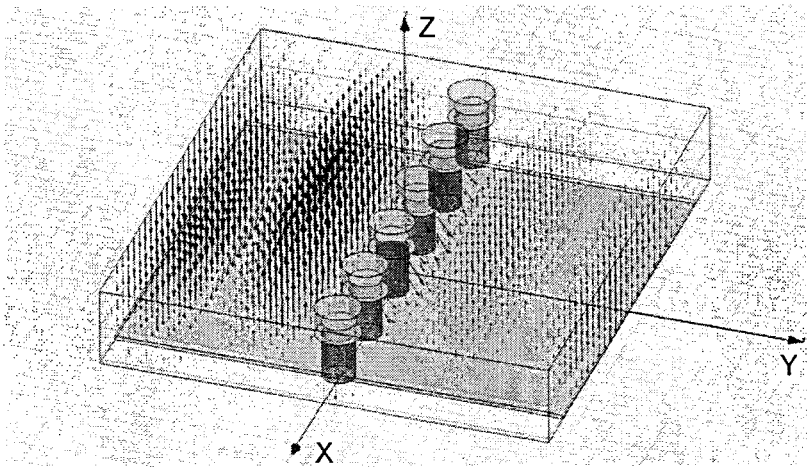
FIG. 38 is a diagram showing the electrical field distribution in the metal case at 10 GHz simulated on the structure of FIG. 36.

FIG. 38 is a diagram showing the electrical field distribution in the metal case 3302 at 10 GHz. Although not apparent from this diagram alone, the results of observation carried out to measure changes in the electrical field vector by varying the input phase on a simulation show that this electrical field is standing waves in the area on the left side of the structural components, and is rightward traveling waves in the area on the right side of the structural components. The transmission coefficient is lowered to approximately −5 dB, because electromagnetic waves are reflected by the plane (the X-Z plane) in which the six structural components are aligned.

Figure 39:
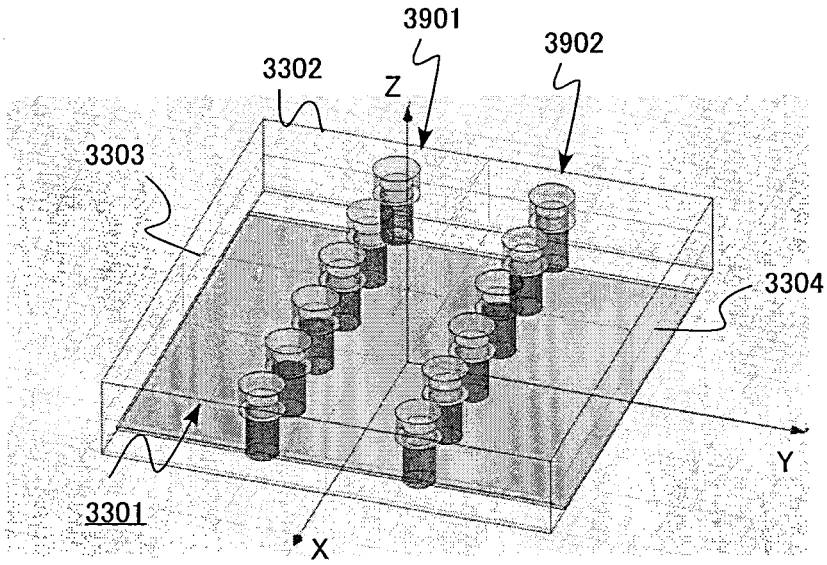
FIG. 39 is a perspective view of a structure on which a three-dimensional electromagnetic field simulation is performed.

FIG. 39 is a perspective view of a structure on which a three-dimensional electromagnetic field simulation is performed. In this structure, two structural component groups 3901 and 3902 are placed to form two reflection planes in the metal case 3302, and a cavity structure is formed. Each six stick-like structural components are collectively referred to as a structural component group. The distance between the two structural component groups in the traveling direction of electromagnetic waves is approximately λ/1.5. The filter circuit pattern of the planar filter 3301 is not shown.

Figure 40:
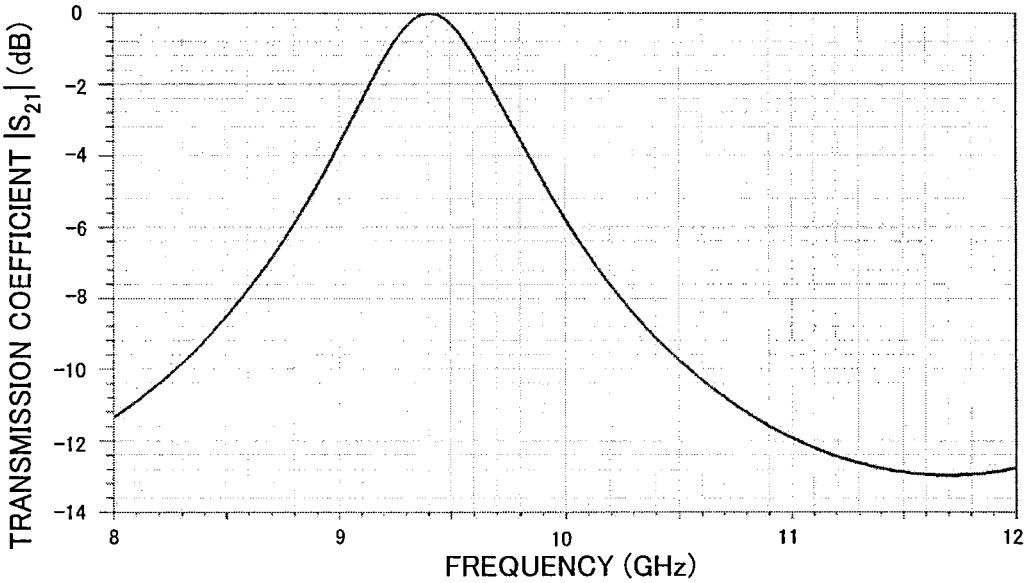
FIG. 40 is a graph showing the results of the simulation performed on the structure of FIG. 39.

FIG. 40 is a graph showing the results of the simulation performed on the structure of FIG. 39. Specifically, FIG. 40 shows the results of a transmission characteristics calculation performed where the left and right surfaces 3303 and 3304 of the metal case 3302 in FIG. 39 were used as the input and output ports. In the graph of FIG. 40, the horizontal axis indicates frequency (8 to 12 GHz), and the vertical axis indicates the transmission coefficient $|S_{21}|$ (−14 to 0 dB) between the ports.

As the two structural component groups are used, a cavity structure is formed, and a resonance peak appears at approximately 9.4 GHz.

Figure 41:
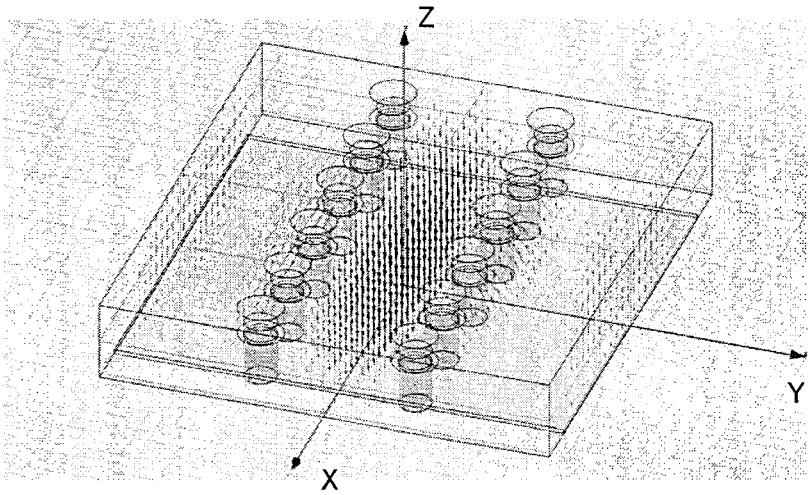
FIG. 41 is a diagram showing the electrical field distribution in the metal case at 9.4 GHz simulated on the structure of FIG. 39.

FIG. 41 is a diagram showing the electrical field distribution in the metal case 3302 at 9.4 GHz simulated on the structure of FIG. 39. As can be seen from the drawing, electromagnetic waves travel back and forth between the two reflection planes and resonate in such a mode that the electrical field concentrates between the structural component groups, since the two reflection planes are formed by the six-stick-like structural components arranged in the direction perpendicular to the propagating direction of the electromagnetic waves.

Figure 42:
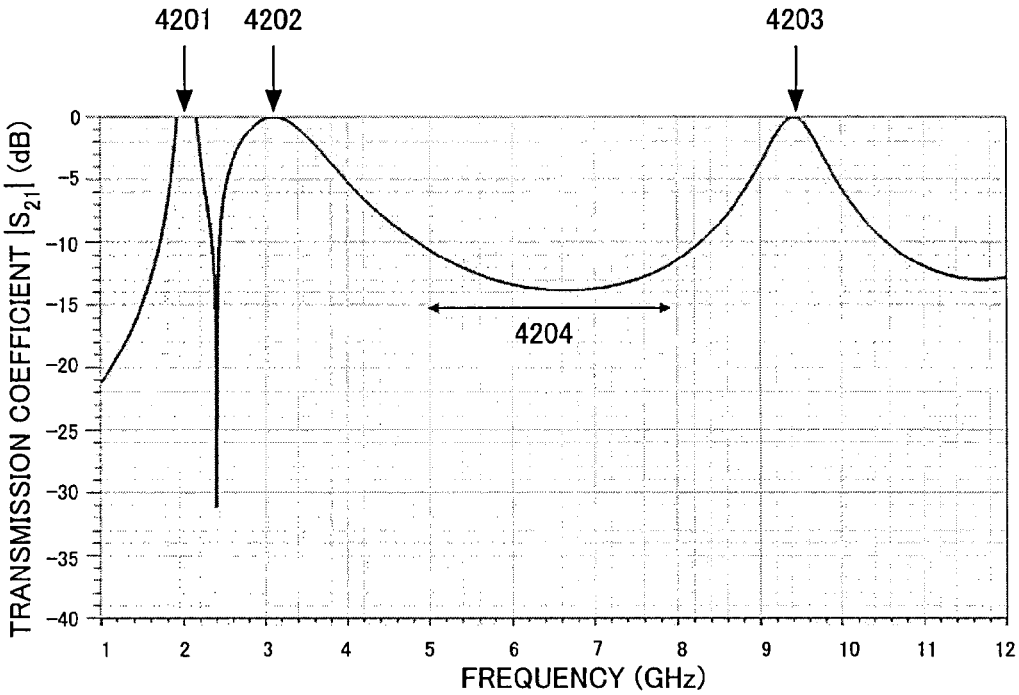
FIG. 42 is a graph showing the results of the simulation performed on the low-frequency side of the structure of FIG. 39.

FIG. 42 is a graph showing the results of the simulation performed on the low-frequency side of the structure of FIG. 39. In the graph of FIG. 42, the horizontal axis indicates frequency (1 to 12 GHz), and the vertical axis indicates the transmission coefficient $|S_{21}|$ (−40 to 0 dB).

As can be seen from the results, there are three transmission peaks denoted by reference numerals 4201, 4202, and 4203 at approximately 2 GHz, 3.1 GHz, and 9.4 GHz, respectively. The peak 4201 is greater than 0 dB, because the calculation diverged near the cutoff frequency of the metal case. Therefore, the peak 4201 is considered to be physically 0 dB.

First, the peak 4203 is caused by the resonance between the structural component groups described with reference to FIG. 41. To determine the causes of the peak 4201 and the peak 4202, the electrical field distributions at the respective frequencies were calculated.

Figure 43:
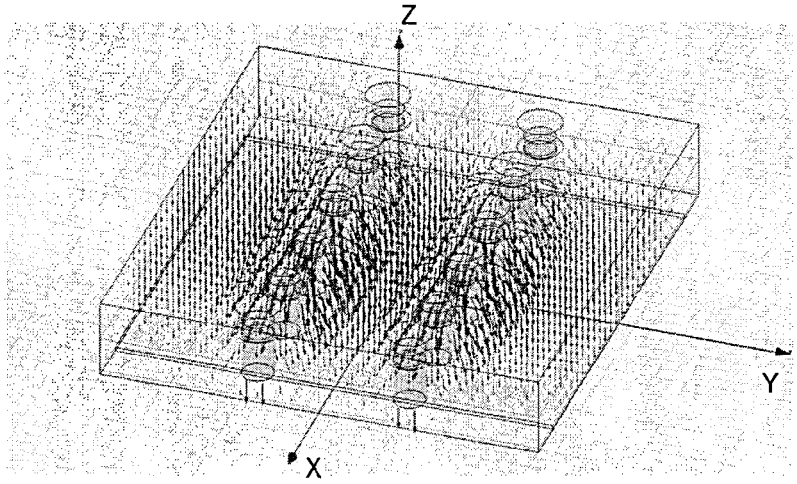
FIG. 43 is a diagram showing the electrical field distribution in the metal case at 2 GHz simulated on the structure of FIG. 39.
Figure 44:
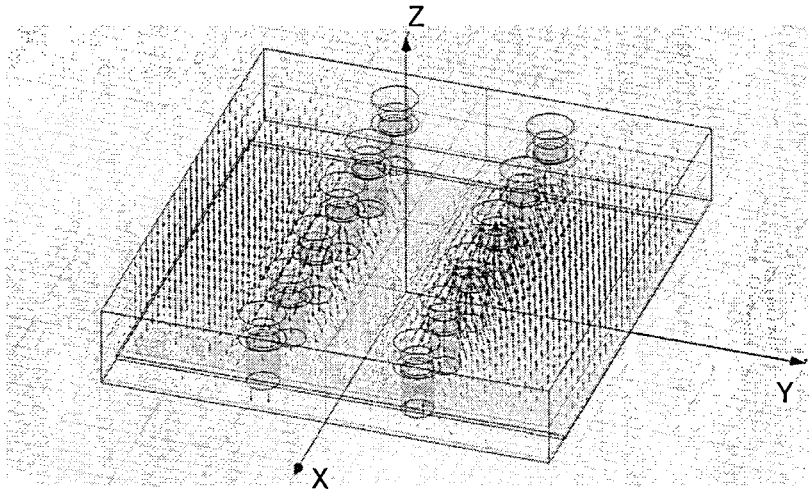
FIG. 44 is a diagram showing the electrical field distribution in the metal case at 3.1 GHz simulated on the structure of FIG. 39.

FIG. 43 is a diagram showing the electrical field distribution in the metal case at 2 GHz. FIG. 44 is a diagram showing the electrical field distribution in the metal case at 3.1 GHz.

As is apparent from FIGS. 43 and 44, the two peaks 4201 and 4202 in FIG. 42 result from the structural component groups themselves working as resonators and resonate. In addition, the electrical field distribution patterns (the same phases in FIG. 43, and the opposite phases in FIG. 44) are typical patterns that are seen in cases where two resonators are coupled to the adjacent other.

Also, as can be seen from FIG. 42, there exists a region where the transmission coefficient is low and propagation of electromagnetic waves is suppressed in a frequency range 4204 between the two peaks 4201 and 4202 and the peak 4203. Accordingly, if the distance between the structural component groups falls within a predetermined range so that such a region exists in the neighborhood of 10 GHz, which is the frequency of the planar filter, the out-of-passband attenuation of the planar filter can be increased. This predetermined range is substantially the same as that of the second embodiment, and is in the range of approximately λ/5 to λ/2 in terms of the electrical length of the center frequency $f_0$ of the passband of the filter.

Figure 45:
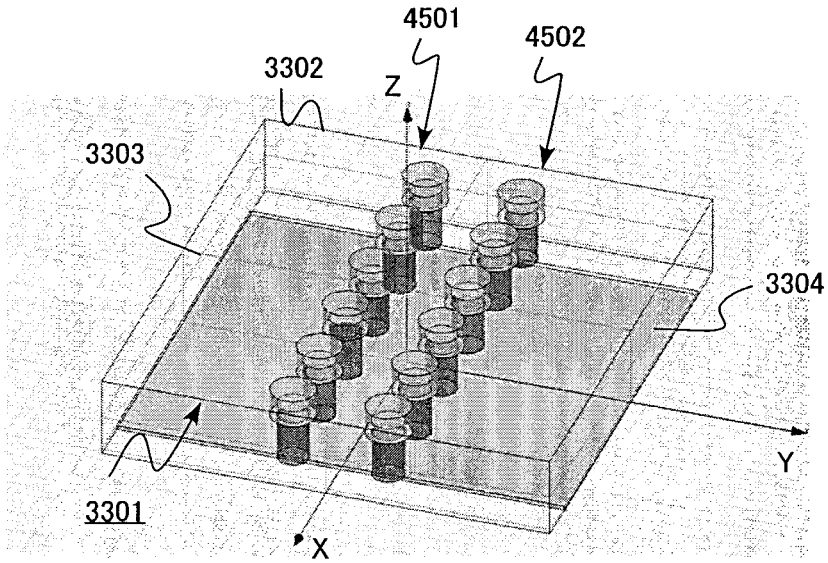
FIG. 45 is a perspective view of a structure on which a three-dimensional electromagnetic field simulation is performed.

FIG. 45 is a perspective view of a structure on which a three-dimensional electromagnetic field simulation is performed. In this structure, two stick-like structural component groups 4501 and 4502 are arranged at a distance of λ/2.5 from each other. The filter circuit pattern of the planar filter 3301 is not shown.

Figure 46:
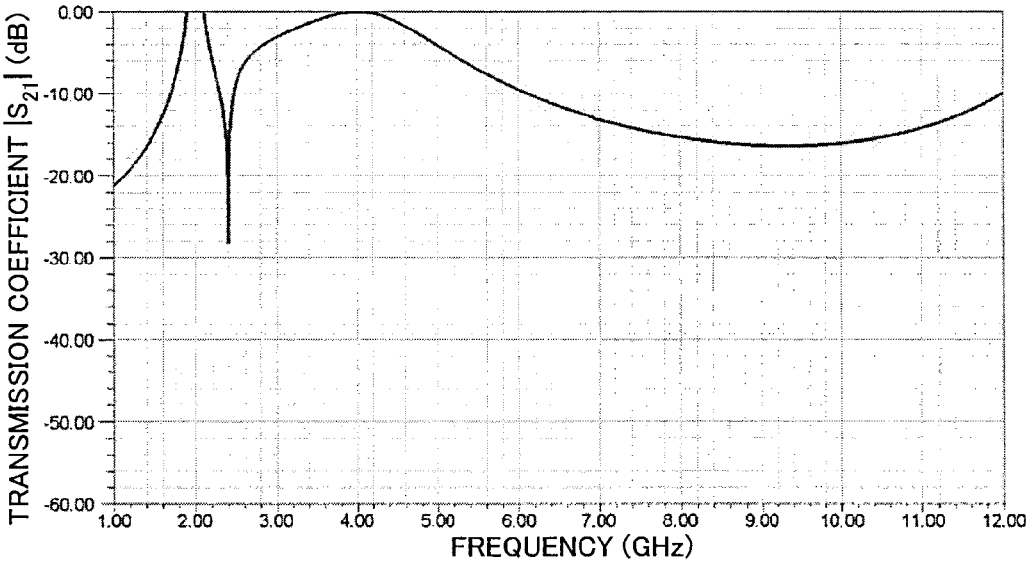
FIG. 46 is a graph showing the results of the simulation performed on the structure of FIG. 45.

FIG. 46 is a graph showing the results of the simulation performed on the structure of FIG. 45. Specifically, FIG. 46 shows the results of a transmission characteristics calculation performed where the left and right surfaces 3303 and 3304 of the metal case 3302 in FIG. 45 were used as the input and output ports. In the graph of FIG. 46, the horizontal axis indicates frequency (1 to 12 GHz), and the vertical axis indicates the transmission coefficient $|S_{21}|$ (−60 to 0 dB).

As is apparent from FIG. 46, the transmission coefficient is suppressed to approximately −16 dB in the regions near 10 GHz, which is the center frequency of the planar filter 3301.

Figure 47:
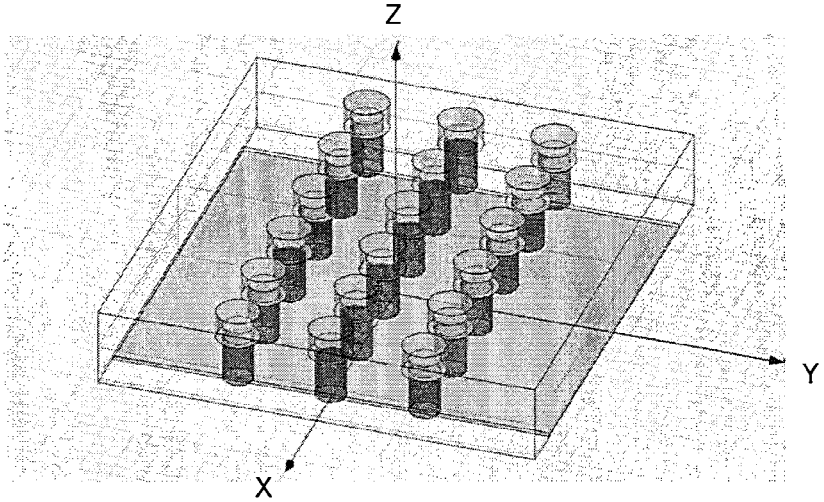
FIG. 47 is a perspective view of a structure that has three stick-like structural component groups unlike the structure of FIG. 45.
Figure 49:
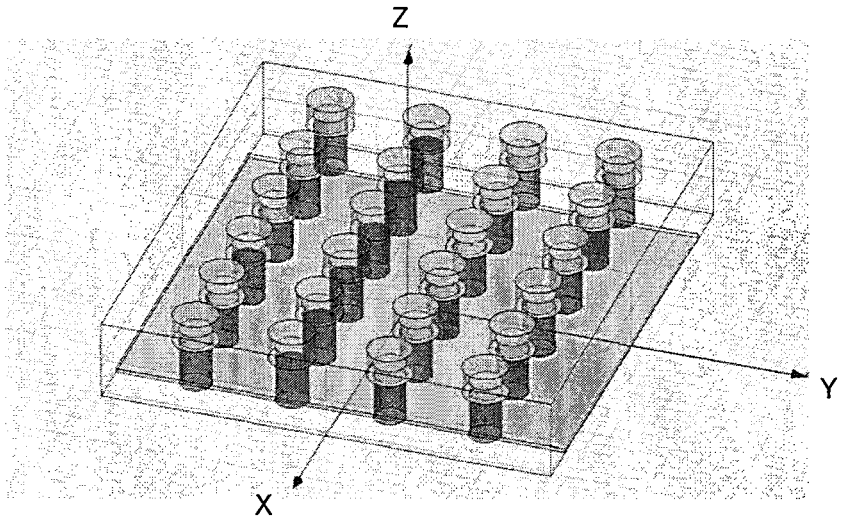
FIG. 49 is a perspective view of a structure that has four stick-like structural component groups unlike the structure of FIG. 45.

FIG. 47 is a perspective view of a structure that includes three stick-like structural component groups unlike the structure of FIG. 45. FIG. 49 is a perspective view of a structure that includes four stick-like structural component groups unlike the structure of FIG. 45. In FIGS. 47 and 49, the distance between each two adjacent structural component groups is λ/2.5.

Figure 48:
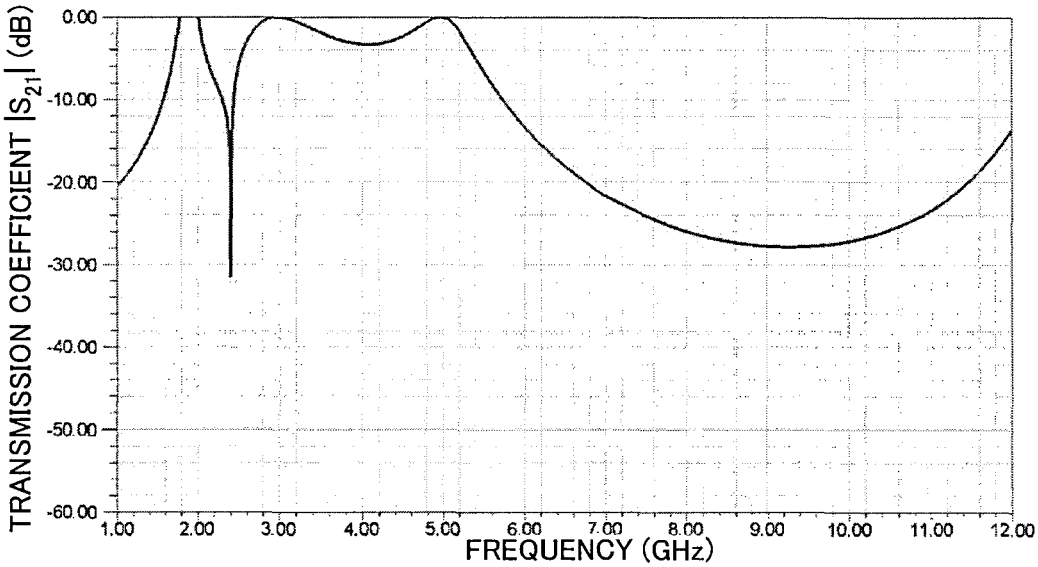
FIG. 48 is a graph showing the results of the simulation performed on the structure of FIG. 47.
Figure 50:
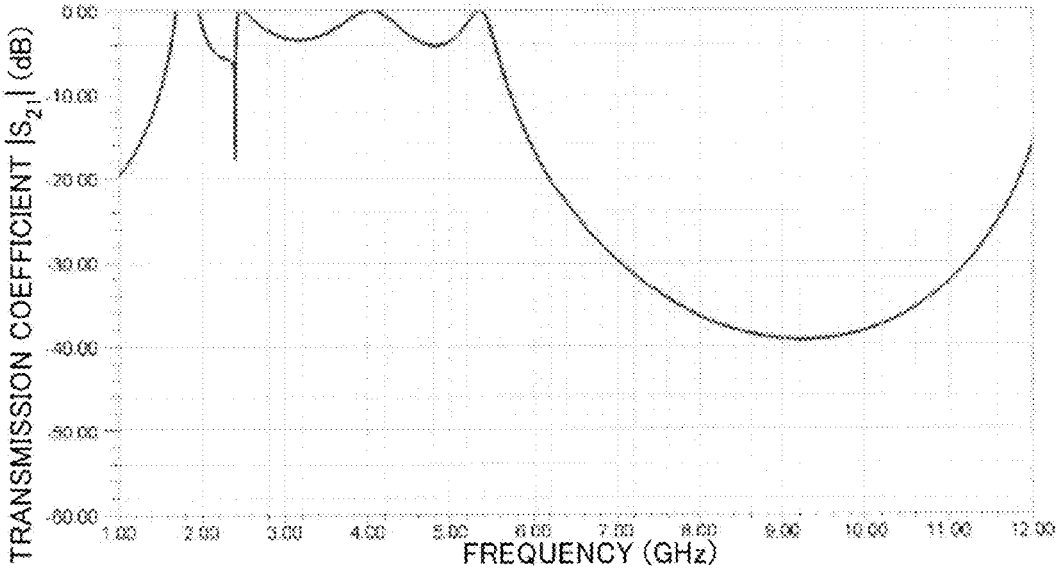
FIG. 50 is a graph showing the results of the simulation performed on the structure of FIG. 49.

FIGS. 48 and 50 are graphs showing the results of the simulations performed on the structures of FIGS. 47 and 49, respectively. In each of FIGS. 48 and 50, the horizontal axis indicates frequency (1 to 12 GHz), and the vertical axis indicates the transmission coefficient $|S_{21}|$ (−60 to 0 dB).

As the number of structural component groups becomes larger, the transmission coefficient in the regions near 10 GHz, which is the frequency of the planar filter, becomes smaller. In view of this, an increase in the number of structural component groups is effective in increasing the out-of-passband attenuation of the planar filter.

As described above, the distance of each two adjacent ones of six stick-like structural components in the X-direction in the drawings is also approximately ⅕ to ½ wavelength in terms of the electrical length of the center frequency $f_0$ of the passband of the planar filter. With this arrangement, propagation of electromagnetic waves in the depth direction (the X-direction) in the drawings can be suppressed. As a result, resonant modes in the depth direction of the metal case are also effectively suppressed.

Figure 51:
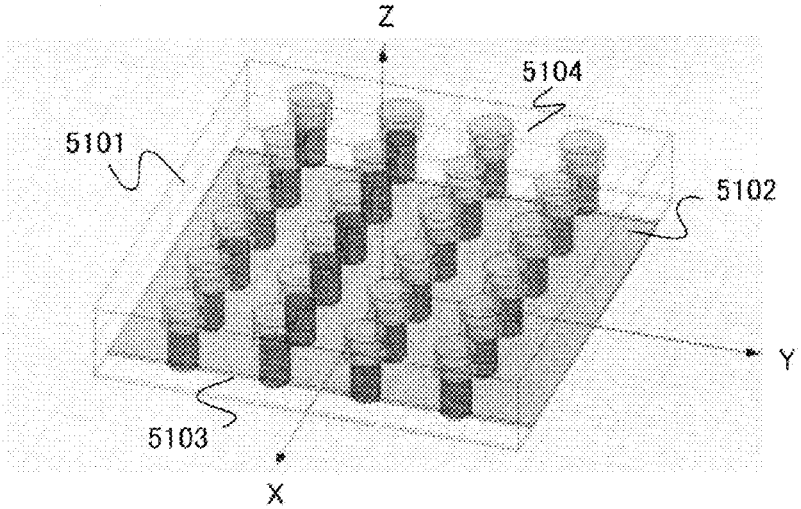
FIG. 51 is a perspective view of a structure on which three-dimensional electromagnetic field simulations are performed.

FIG. 51 is a perspective view of a structure on which three-dimensional electromagnetic field simulations are performed. In FIG. 51, the distance between each two adjacent stick-like structural components in the depth direction is $\lambda/3$. The layout of the metal case and the structural components are the same as that shown in FIG. 32.

Figure 52:
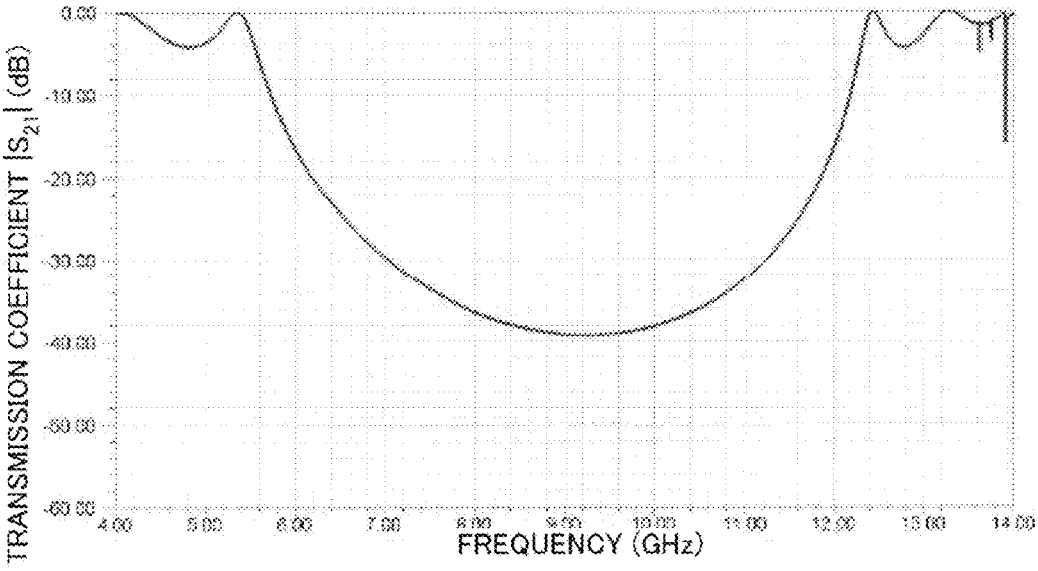
FIG. 52 is a graph showing the result of a simulation performed on the structure of FIG. 51 when the left and right surfaces of the metal case were used as the input and output ports.
Figure 53:
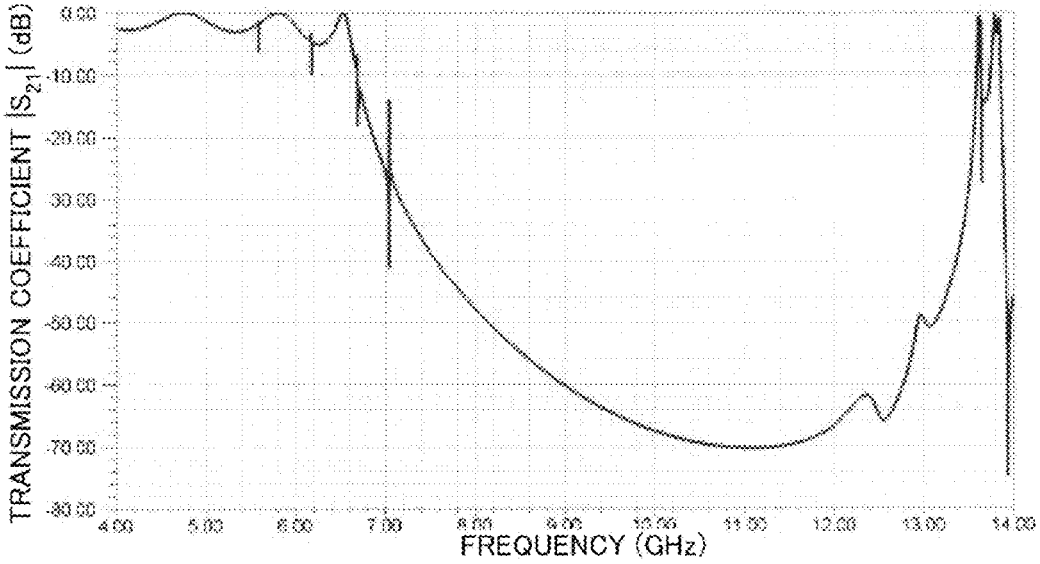
FIG. 53 is a graph showing the result of another simulation performed on the structure of FIG. 51 when the surfaces in the depth direction (the X-direction) were used as the input and output ports.

FIGS. 52 and 53 are graphs showing the results of simulations performed on the structure of FIG. 51. Specifically, FIG. 52 shows the results of a transmission characteristics calculation performed where the surfaces 5101 and 5102 in FIG. 51 in left to right direction (the Y-direction) of the metal case were used as the input and output ports. FIG. 53 shows the results of a transmission characteristics calculation performed where the surfaces 5103 and 5104 in FIG. 51 in the depth direction (the X-direction) were used as the input and output ports. In the graph of FIG. 52, the horizontal axis indicates frequency (4 to 14 GHz), and the vertical axis indicates the transmission coefficient $|S_{21}|$ (−60 to 0 dB). In the graph of FIG. 53, the horizontal axis indicates frequency (4 to 14 GHz), and the vertical axis indicates the transmission coefficient $|S_{21}|$ (−80 to 0 dB).

As can be seen from FIGS. 52 and 53, propagation is suppressed in the regions near 10 GHz, which is the frequency of the planar filter in both cases.

As described above, this embodiment further includes moving mechanisms that moves the stick-like dielectric components up and down in the longitudinal direction thereof. As shown in FIG. 32, in the stick-like structural components, the dielectric components 3203*b*, 3204*b*, 3205*b* and 3206*b* are respectively stacked below the metal portions 3203*a*, 3204*a*, 3205*a* and 3206*a* in the longitudinal direction of the sticks. Each of the metal portions protrudes from the metal case to the outside. For example, by rotating a protruding metal portion, the corresponding dielectric component can be moved up and down in the longitudinal direction of the stick. The metal portions are bonded to the dielectric portions, so that the dielectric portions can be moved up and down from the outside the metal case, and the planar filter is entirely covered with the metal.

Further, the stick-like dielectric components are placed immediately above the resonators 3201*c*. In other words, the resonators 3201*c* forming the planar filter are located below the dielectric structural components, and the center frequencies of the resonators 3201*c* can be adjusted by moving the stick-like dielectric components. Accordingly, fine frequency adjustment can be performed while propagation of electromagnetic waves in the metal case is suppressed. Thus, this embodiment is particularly effective for narrowband filters.

Figure 54:
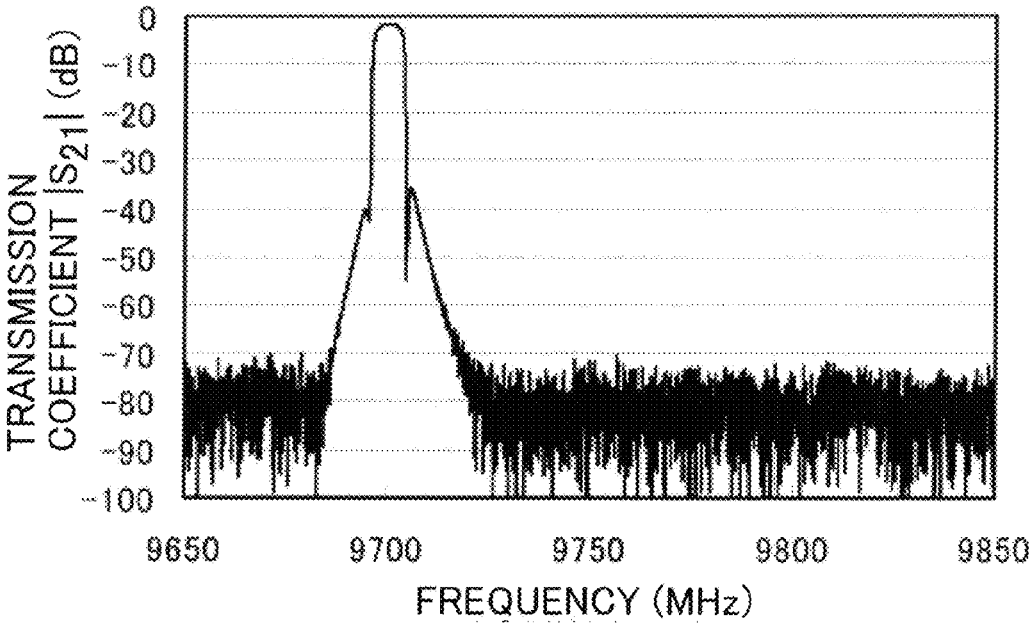
FIG. 54 is a graph showing the results of a frequency adjustment experiment.
Figure 55:
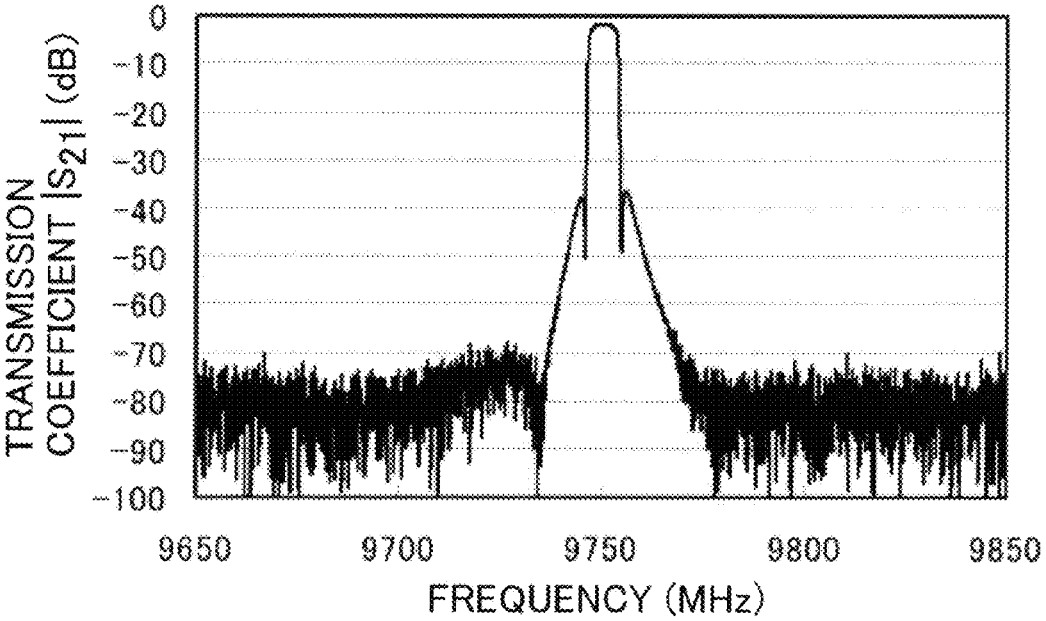
FIG. 55 is a graph showing the results of another frequency adjustment experiment.
Figure 56:
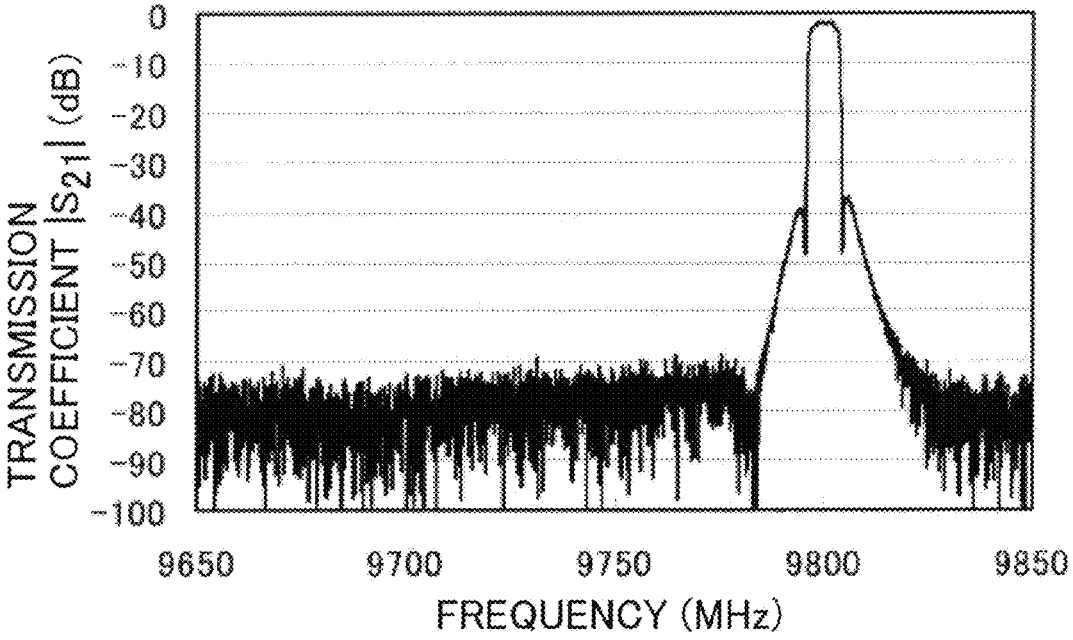
FIG. 56 is a graph showing the results of yet another frequency adjustment experiment.

As examples, experiments to adjust the center frequencies of filters to 9700 MHz, 9750 MHz, and 9800 MHz were carried out using the same structure as that of FIG. 32. FIGS. 54, 55, and 56 are graphs showing the results of the frequency adjustment experiments. In each of FIGS. 54, 55, and 56, the horizontal axis indicates frequency (9650 to 9850 MHz), and the vertical axis indicates the filter transmission coefficient $|S_{21}|$ (−100 to 0 dB).

As fine frequency adjustment can be performed, center frequencies of filters can be changed. In addition, the metal portions 3203*b*, 3204*b*, 3205*b* and 3206*b* of the structural component in FIG. 32 advantageously shield electromagnetic waves from outside.

The conductor portion of the planar filter is made of a superconductor. The pattern portions of the input line 3201*a*, the output line 3201*b*, and the resonators 3201*c* in FIG. 32 are formed with a superconductive thin film on a surface of a substrate. Although not shown in the drawing, the ground plane on the opposite surface of the substrate from the pattern portions is also formed with a superconductive thin film.

As described above, in a filter of this embodiment, stick-like dielectric structural components are arranged at predetermined intervals. Accordingly, electromagnetic wave propagation in the metal case is suppressed, without adverse influence on the characteristics of the planar filter. Thus, a filter that has the original characteristics of a planar filter can be provided.

Also, the center frequencies of resonators can be adjusted by moving stick-like structural components. Accordingly, fine frequency adjustment can be performed while electromagnetic wave propagation in the metal case is suppressed, without any additional adjustment mechanism.

Further, the conductor portion of the planar filter is made of a superconductor. Accordingly, a low-loss filter is realized.

While certain embodiments have been described, these embodiments have been presented by way of example only, and are not intended to limit the scope of the inventions. Indeed, the filters described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A filter comprising:

a microstrip-line planar filter including an input line, a plurality of resonators, and an output line, the microstrip-line planar filter having a passband with a center frequency $f_0$;

a metal case to house the planar filter; and a plurality of structural components including dielectric components, the plurality of structural components being arranged in the metal case at a first interval in a first direction, the first direction being a traveling direction of electromagnetic waves from the input line to the output line and a direction perpendicular to a wavefront of standing waves generated by electromagnetic waves resonating in the metal case, the first interval being ⅕ to ½ wavelength in terms of an electrical length of the center frequency $f_0$.

2. The filter according to claim 1, wherein the dielectric components have stick-like forms.

3. The filter according to claim 2, wherein the plurality of structural components are also arranged at a second interval in a second direction, the second direction being a direction perpendicular to the traveling direction of the electromagnetic waves and a direction parallel to the wavefront of the standing waves.

4. The filter according to claim 3, wherein the second interval being ⅕ to ½ wavelength in terms of the electrical length of the center frequency $f_0$.

5. The filter according to claim 2, wherein the plurality of structural components include a moving mechanism for moving the dielectric components up and down along a longitudinal direction of the stick-like forms.

6. The filter according to claim 5, wherein the dielectric components are placed immediately above the resonators.

7. The filter according to claim 5, wherein the plurality of structural components include metal portions connected to the dielectric components, the metal portions protrude from the metal case, the dielectric components are moved in the longitudinal direction of the stick-like forms by rotating part of the metal portions.

8. The filter according to claim 1, wherein the microstrip-line planar filter includes a dielectric substrate, a ground plane provided at a lower surface of the dielectric substrate, and a filter circuit pattern provided at the upper surface of the dielectric substrate, and the ground plane and the filter circuit pattern made of a superconductor.

9. The filter according to claim 1, wherein the dielectric components have plate-like forms.

* * * * *